US008687031B2

(12) United States Patent
Imai

(10) Patent No.: US 8,687,031 B2
(45) **Date of Patent: *Apr. 1, 2014**

(54) THERMAL PRINTER

(71) Applicant: Seiko Epson Corporation, Tokyo (JP)

(72) Inventor: Satoru Imai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/758,620

(22) Filed: Feb. 4, 2013

(65) Prior Publication Data

US 2013/0147893 A1 Jun. 13, 2013

Related U.S. Application Data

(60) Continuation of application No. 12/856,173, filed on Aug. 13, 2010, now Pat. No. 8,393,695, which is a division of application No. 11/463,253, filed on Aug. 8, 2006, now Pat. No. 7,802,857.

(30) Foreign Application Priority Data

Aug. 19, 2005 (JP) ..... 2005-239171

(51) Int. Cl.
*B41J 2/36* (2006.01)

(52) U.S. Cl.
USPC ..... 347/195; 347/5; 347/211

(58) Field of Classification Search
USPC ..... 347/5, 9, 12, 14, 15, 195, 211
See application file for complete search history.

(56) References Cited

U.S. PATENT DOCUMENTS

| | | | | |
|---|---|---|---|---|
| 4,770,552 | A | 9/1988 | Nishijima et al. | |
| 6,476,839 | B1 | 11/2002 | Nakajima et al. | |
| 7,802,857 | B2 * | 9/2010 | Imai | 347/5 |
| 8,164,608 | B2 * | 4/2012 | Imai | 347/195 |
| 8,393,695 | B2 * | 3/2013 | Imai | 347/5 |
| 2002/0191067 | A1 | 12/2002 | Nakajima et al. | |

FOREIGN PATENT DOCUMENTS

| | | | |
|---|---|---|---|
| EP | 1 070 593 | A2 | 1/2001 |
| EP | 1 226 952 | A1 | 7/2002 |
| JP | 2836584 | | 10/1998 |
| JP | 200188340 | | 4/2001 |
| JP | 200425575 | | 1/2004 |
| JP | 2004192254 | | 7/2004 |

* cited by examiner

*Primary Examiner* — Lam S Nguyen

(57) ABSTRACT

A printing control unit for a thermal printer that prints by applying heat energy to a recording medium and is able to operate in multiple print modes, includes a line buffer unit, a shift register unit, and a configuration registration unit. The line buffer unit accumulates current dot printing data supplied from a host. The shift register unit gets and passes the current dot printing data and previous dot history data from the line buffer unit to a logic circuit unit. The configuration registration unit stores configuration data for setting data logic of the logic circuit unit.

2 Claims, 29 Drawing Sheets

| current line | current line | $d_0$ current line | | $\overline{d_0}$ | |
|---|---|---|---|---|---|
| | previous line | $d_1$ previous line | $\overline{d_1}$ | $\overline{d_1}$ | $d_1$ previous line |
| $d_2$ 2 lines before | $d_3$ 3 lines before | b15 | b13 | b12 | b14 |
| | $\overline{d_3}$ | b7 | b5 | b4 | b6 |
| $\overline{d_2}$ | $\overline{d_3}$ | b3 | b1 | b0 | b2 |
| | $d_3$ 3 lines before | b11 | b9 | b8 | b10 |

FIG. 6

| current line | current line | $d_0$ black | | $\overline{d_0}$ red·non-printing | |
|---|---|---|---|---|---|
| | previous line | $d_1$ black | $\overline{d_1}$ red·non-printing | $\overline{d_1}$ red·non-printing | $d_1$ black |
| $d_2$ red (black) | $d_3$ red (black) | b15 | b13 | b12 | b14 |
| | $\overline{d_3}$ black·non-printing | b7 | b5 | b4 | b6 |
| $\overline{d_2}$ black·non-printing | $\overline{d_3}$ black·non-printing | b3 | b1 | b0 | b2 |
| | $d_3$ red (black) | b11 | b9 | b8 | b10 |

FIG. 7

| current line | current line | $d_0$ current line | | $\overline{d_0}$ | |
|---|---|---|---|---|---|
| | previous line | $d_1$ previous line | $\overline{d_1}$ | $\overline{d_1}$ | $d_1$ previous line |
| $d_2$ 2 lines before | $d_3$ 3 lines before | 0 | 1 (b13) | 0 | 0 |
| | $\overline{d_3}$ | 0 | 1 (b5) | 0 | 0 |
| $\overline{d_2}$ | $\overline{d_3}$ | 0 | 1 (b1) | 0 | 0 |
| | $d_3$ 3 lines before | 0 | 1 (b9) | 0 | 0 |

(bit correlation table)

| current line | current line | $d_0$ current line | | $\overline{d_0}$ | |
|---|---|---|---|---|---|
| | previous line | $d_1$ previous line | $\overline{d_1}$ | $\overline{d_1}$ | $d_1$ previous line |
| $d_2$ 2 lines before | $d_3$ 3 lines before | b15 | b13 | b12 | b14 |
| | $\overline{d_3}$ | b7 | b5 | b4 | b6 |
| $\overline{d_2}$ | $\overline{d_3}$ | b3 | b1 | b0 | b2 |
| | $d_3$ 3 lines before | b11 | b9 | b8 | b10 |

FIG.11

| current line | current line / previous line | $d_0$ current line | | $\overline{d_0}$ | |
|---|---|---|---|---|---|
| | | $d_1$ previous line | $\overline{d_1}$ | $\overline{d_1}$ | $d_1$ previous line |
| $d_2$ 2 lines before | $d_3$ 3 lines before | 1 (b15) | 1 (b13) | 0 | 0 |
| | $\overline{d_3}$ | 1 (b7) | 1 (b5) | 0 | 0 |
| $\overline{d_2}$ | $\overline{d_3}$ | 1 (b3) | 1 (b1) | 0 | 0 |
| | $d_3$ 3 lines before | 1 (b11) | 1 (b9) | 0 | 0 |

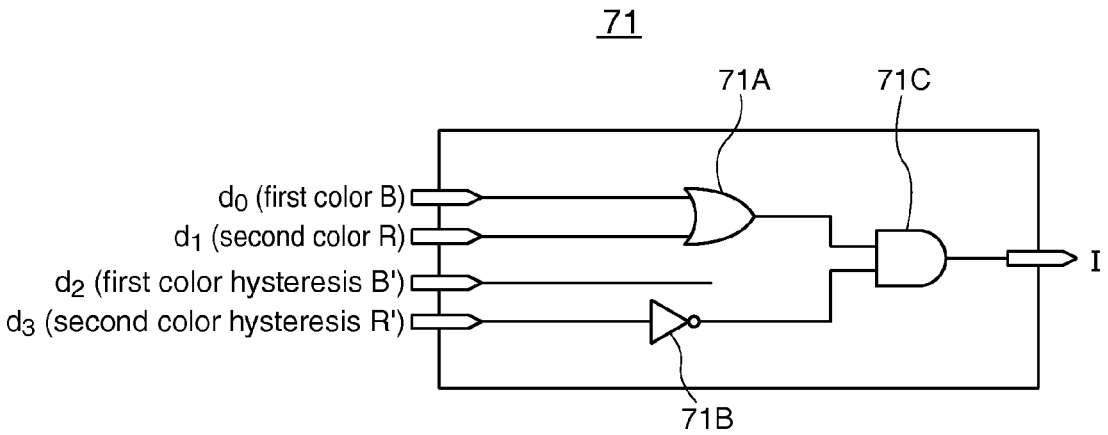

$I = \overline{d_3} \cdot (d_0 + d_1) \rightarrow I = R' \cdot (B + R)$

FIG.18

I Energize period

| current line | current line | $d_0$ black | | $\overline{d_0}$ red·non-printing | |
|---|---|---|---|---|---|
| | previous line | $d_1$ black | $\overline{d_1}$ red·non-printing | $\overline{d_1}$ red·non-printing | $d_1$ black |
| $d_2$ red (black) | $d_3$ red (black) | 0 | 0 | 0 | 0 |
| | $\overline{d_3}$ black·non-printing | 1 (b7) | 1 (b5) | 1 (b4) | 1 (b6) |
| $\overline{d_2}$ black·non-printing | $\overline{d_3}$ black·non-printing | 1 (b3) | 1 (b1) | 0 | 0 |
| | $d_3$ red (black) | 0 | 0 | 0 | 0 |

FIG.19

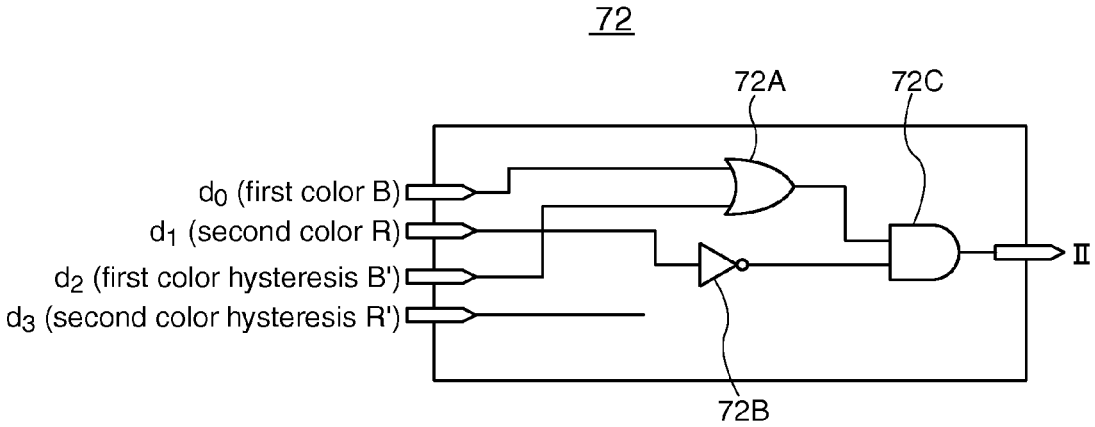

$II = \overline{d_1} \cdot (d_0 + d_2) \rightarrow II = B' \cdot (B + R)$

FIG.20

II Energize period

| current line | current line | $d_0$ black | | $\overline{d_0}$ red·non-printing | |
|---|---|---|---|---|---|
| | previous line | $d_1$ black | $\overline{d_1}$ red·non-printing | $\overline{d_1}$ red·non-printing | $d_1$ black |
| $d_2$ red (black) | $d_3$ red (black) | 0 | 1 (b13) | 1 (b12) | 0 |
| | $\overline{d_3}$ black·non-printing | 0 | 1 (b5) | 1 (b4) | 0 |
| $\overline{d_2}$ black·non-printing | $\overline{d_3}$ black·non-printing | 0 | 1 (b1) | 0 | 0 |
| | $d_3$ red (black) | 0 | 1 (b9) | 0 | 0 |

FIG.21

Ⅲ Energize period

| current line | current line | $d_0$ black | | $\overline{d_0}$ red·non-printing | |
|---|---|---|---|---|---|
| | previous line | $d_1$ black | $\overline{d_1}$ red·non-printing | $\overline{d_1}$ red·non-printing | $d_1$ black |
| $d_2$ red (black) | $d_3$ red (black) | 1 (b15) | 1 (b13) | 0 | 0 |
| | $\overline{d_3}$ black·non-printing | 1 (b7) | 1 (b5) | 0 | 0 |
| $\overline{d_2}$ black·non-printing | $\overline{d_3}$ black·non-printing | 1 (b3) | 1 (b1) | 0 | 0 |
| | $d_3$ red (black) | 1 (b11) | 1 (b9) | 0 | 0 |

I Energize period

| current line | current line | $d_0$ black | | $\overline{d_0}$ red·non-printing | |
|---|---|---|---|---|---|
| | previous line | $d_1$ black | $\overline{d_1}$ red·non-printing | $\overline{d_1}$ red·non-printing | $d_1$ black |
| $d_2$ red (black) | $d_3$ red (black) | 0 | 0 | 1 | 0 |
| | $\overline{d_3}$ black·non-printing | 0 | 1 | 0 | 0 |
| $\overline{d_2}$ black·non-printing | $\overline{d_3}$ black·non-printing | 0 | 1 | 0 | 0 |
| | $d_3$ red (black) | 0 | 0 | 0 | 0 |

FIG.26

II Energize period

| current line | current line | $d_0$ black | | $\overline{d_0}$ red·non-printing | |
|---|---|---|---|---|---|
| | previous line | $d_1$ black | $\overline{d_1}$ red·non-printing | $\overline{d_1}$ red·non-printing | $d_1$ black |
| $d_2$ red (black) | $d_3$ red (black) | 1 | 1 | 0 | 0 |
| | $\overline{d_3}$ black·non-printing | 1 | 1 | 0 | 0 |
| $\overline{d_2}$ black·non-printing | $\overline{d_3}$ black·non-printing | 1 | 1 | 0 | 0 |
| | $d_3$ red (black) | 1 | 1 | 0 | 0 |

FIG.27

Ⅲ Energize period

| current line | current line | $d_0$ black | | $\overline{d_0}$ red·non-printing | |
|---|---|---|---|---|---|
| | previous line | $d_1$ black | $\overline{d_1}$ red·non-printing | $\overline{d_1}$ red·non-printing | $d_1$ black |
| $d_2$ red (black) | $d_3$ red (black) | 1 | 1 | 0 | 0 |
| | $\overline{d_3}$ black·non-printing | 1 | 1 | 1 | 0 |
| $\overline{d_2}$ black·non-printing | $\overline{d_3}$ black·non-printing | 1 | 1 | 0 | 0 |
| | $d_3$ red (black) | 1 | 1 | 0 | 0 |

FIG.28

Ⅳ Energize period

| current line | current line | $d_0$ black | | $\overline{d_0}$ red·non-printing | |
|---|---|---|---|---|---|
| | previous line | $d_1$ black | $\overline{d_1}$ red·non-printing | $\overline{d_1}$ red·non-printing | $d_1$ black |
| $d_2$ red (black) | $d_3$ red (black) | 1 | 1 | 1 | 1 |
| | $\overline{d_3}$ black·non-printing | 1 | 1 | 1 | 1 |
| $\overline{d_2}$ black·non-printing | $\overline{d_3}$ black·non-printing | 1 | 1 | 0 | 0 |
| | $d_3$ red (black) | 1 | 1 | 0 | 0 |

FIG.29

I Energize period

| current line | current line | $d_0$ C0,C1 | | $\overline{d_0}$ C2,C3 | |
|---|---|---|---|---|---|
| | previous line | $d_1$ C1,C3 | $\overline{d_1}$ C0,C2 | $\overline{d_1}$ C0,C2 | $d_1$ C1,C3 |
| $d_2$ C2,C3 | $d_3$ C2,C3 | 1 | 1 | 1 | 1 |
| | $\overline{d_3}$ C0,C1 | 1 | 1 | 1 | 1 |
| $\overline{d_2}$ C0,C1 | $\overline{d_3}$ C0,C1 | 0 | 0 | 0 | 0 |
| | $d_3$ C2,C3 | 0 | 0 | 0 | 0 |

C0 : level 0
C1 : level 1
C2 : level 2
C3 : level 3

FIG.32

II Energize period

| current line | current line | $d_0$ C0,C1 | | $\overline{d_0}$ C2,C3 | |
|---|---|---|---|---|---|
| | previous line | $d_1$ C1,C3 | $\overline{d_1}$ C0,C2 | $\overline{d_1}$ C0,C2 | $d_1$ C1,C3 |
| $d_2$ C2,C3 | $d_3$ C2,C3 | 1 | 1 | 0 | 0 |
| | $\overline{d_3}$ C0,C1 | 1 | 1 | 0 | 0 |
| $\overline{d_2}$ C0,C1 | $\overline{d_3}$ C0,C1 | 1 | 1 | 0 | 0 |
| | $d_3$ C2,C3 | 1 | 1 | 0 | 0 |

C0 : level 0
C1 : level 1
C2 : level 2
C3 : level 3

FIG.33

Ⅲ Energize period

| current line | current line | $d_0$ C0,C1 | | $\overline{d_0}$ C2,C3 | |
|---|---|---|---|---|---|
| | previous line | $d_1$ C1,C3 | $\overline{d_1}$ C0,C2 | $\overline{d_1}$ C0,C2 | $d_1$ C1,C3 |
| $d_2$ C2,C3 | $d_3$ C2,C3 | 0 | 0 | 0 | 0 |
| | $\overline{d_3}$ C0,C1 | 0 | 0 | 0 | 0 |
| $\overline{d_2}$ C0,C1 | $\overline{d_3}$ C0,C1 | 1 | 1 | 1 | 1 |
| | $d_3$ C2,C3 | 1 | 1 | 1 | 1 |

C0 : level 0
C1 : level 1
C2 : level 2
C3 : level 3

FIG.34

Ⅳ Energize period

| current line | current line | $d_0$ C0,C1 | | $\overline{d_0}$ C2,C3 | |
|---|---|---|---|---|---|
| | previous line | $d_1$ C1,C3 | $\overline{d_1}$ C0,C2 | $\overline{d_1}$ C0,C2 | $d_1$ C1,C3 |
| $d_2$ C2,C3 | $d_3$ C2,C3 | 0 | 0 | 1 | 0 |
| | $\overline{d_3}$ C0,C1 | 0 | 1 | 0 | 0 |
| $\overline{d_2}$ C0,C1 | $\overline{d_3}$ C0,C1 | 0 | 1 | 1 | 0 |
| | $d_3$ C2,C3 | 0 | 1 | 1 | 0 |

C0 : level 0
C1 : level 1
C2 : level 2
C3 : level 3

FIG.35

| | | 0 | 1 | 2 | 3 | 4 | 5 | 6 | 7 | 8 | 9 | 10 | 11 | 12 | |
|---|---|---|---|---|---|---|---|---|---|---|---|---|---|---|---|
| current | | □ | □ | ■ | ■ | ▨ | ▒ | ■ | ■ | ▩ | ■ | ■ | ■ | ■ | |
| applied energy | level | | | | | | | | | | | | | | component pulses |
| 0.00mj | 0 | * | | | | | | | | | | | | | |
| | 1 | | | | | | | | | | | | | | fourth |
| | 2 | | does not print (these levels are not used) | | | | | | | | | | | | third |
| | 3 | | | | | | | | | | | | | | third + fourth |
| 0.104mj | 4 | | * | | | | | | | | | | | | second |
| 0.13mj | 5 | | | * | | | | | | | | | | | second + fourth |
| 0.156mj | 6 | | | | * | | | | | | | | | | second + third |
| 0.182mj | 7 | | | | | * | | | | | | | | | second + third + fourth |
| 0.208mj | 8 | | | | | | * | | | | | | | | first |
| 0.234mj | 9 | | | | | | | * | | | | | | | first + fourth |
| 0.26mj | 10 | | | | | | | | * | | | | | | first + third |
| 0.286mj | 11 | | | | | | | | | * | | | | | first + third + fourth |
| 0.312mj | 12 | | | | | | | | | | * | | | | first + second |
| 0.338mj | 13 | | | | | | | | | | | * | | | first + second + fourth |
| 0.364mj | 14 | | | | | | | | | | | | * | | first + second + third |
| 0.39mj | 15 | | | | | | | | | | | | | * | first + second + third + fourth |

(Note: Applied energy in the standard energize pulse period is 0.39 mj.)

| | | | | | | | | | | | | | | |
|---|---|---|---|---|---|---|---|---|---|---|---|---|---|---|
| buffer * | 0 | 0 | 0 | 0 | 0 | 0 | 0 | 0 | 0 | 0 | 0 | 0 | 0 | reset hysteresis buffer |
| * | 0 | 0 | 0 | 0 | 0 | 0 | 0 | 0 | 0 | 0 | 0 | 0 | 0 | reset hysteresis buffer |
| buffer A(d0) | 0 | 0 | 0 | 0 | 0 | 1 | 1 | 1 | 1 | 1 | 1 | 1 | 1 | print density level = 5 or higher |
| B(d1) | 0 | 1 | 1 | 1 | 1 | 0 | 0 | 0 | 0 | 1 | 1 | 1 | 1 | print density level = 1 to 4, or 9 to 12 |
| C(d2) | 0 | 0 | 0 | 1 | 1 | 0 | 0 | 1 | 1 | 0 | 0 | 1 | 1 | print density level = 3,4,7,8,11,12 |
| D(d3) | 0 | 0 | 1 | 0 | 1 | 0 | 1 | 0 | 1 | 0 | 0 | 0 | 1 | print density level = 2,4,6,8 · · · |

| (Output pulses based on conditions stored in buffers A to D) | | | | | | | | | | | | | | logic operation |
|---|---|---|---|---|---|---|---|---|---|---|---|---|---|---|
| first pulse | | | | | | ■ | ■ | ■ | ■ | ■ | ■ | ■ | ■ | A |
| second pulse | | ■ | ■ | ■ | ■ | | | | | ■ | ■ | ■ | ■ | B |
| third pulse | | | | ■ | ■ | | | ■ | ■ | | | ■ | ■ | C |
| fourth pulse | | | ■ | | ■ | | ■ | | ■ | | ■ | | ■ | D |

FIG.36

I Energize period

| current line | current line | $d_0$ A | | $\overline{d_0}$ $\overline{A}$ | |
|---|---|---|---|---|---|
| | previous line | $d_1$ B | $\overline{d_1}$ $\overline{B}$ | $\overline{d_1}$ $\overline{B}$ | $d_1$ B |
| $d_2$ C | $d_3$ D | 1 | 1 | 0 | 0 |
| | $\overline{d_3}$ $\overline{D}$ | 1 | 1 | 0 | 0 |
| $\overline{d_2}$ $\overline{C}$ | $\overline{d_3}$ $\overline{D}$ | 1 | 1 | 0 | 0 |
| | $d_3$ D | 1 | 1 | 0 | 0 |

Condition A: print density level = 5 or higher
Condition B: print density level = 1 to 4, or 9 to 12
Condition C: print density levels 3, 4, 7, 8, 11, 12
Condition D: print density levels 2, 4, 6, 8, 10, 12

FIG.37

II Energize period

| current line | current line | $d_0$ A | | $\overline{d_0}$ $\overline{A}$ | |
|---|---|---|---|---|---|
| | previous line | $d_1$ B | $\overline{d_1}$ $\overline{B}$ | $\overline{d_1}$ $\overline{B}$ | $d_1$ B |
| $d_2$ C | $d_3$ D | 1 | 0 | 0 | 1 |
| | $\overline{d_3}$ $\overline{D}$ | 1 | 0 | 0 | 1 |
| $\overline{d_2}$ $\overline{C}$ | $\overline{d_3}$ $\overline{D}$ | 1 | 0 | 0 | 1 |
| | $d_3$ D | 1 | 0 | 0 | 1 |

Condition A: print density level = 5 or higher
Condition B: print density level = 1 to 4, or 9 to 12
Condition C: print density levels 3, 4, 7, 8, 11, 12
Condition D: print density levels 2, 4, 6, 8, 10, 12

FIG.38

Ⅲ Energize period

| current line | current line | $d_0$ A | | $\overline{d_0}$ $\overline{A}$ | |
|---|---|---|---|---|---|
| | previous line | $d_1$ B | $\overline{d_1}$ $\overline{B}$ | $\overline{d_1}$ $\overline{B}$ | $d_1$ B |
| $d_2$ C | $d_3$ D | 1 | 1 | 1 | 1 |
| | $\overline{d_3}$ $\overline{D}$ | 1 | 1 | 1 | 1 |
| $\overline{d_2}$ $\overline{C}$ | $\overline{d_3}$ $\overline{D}$ | 0 | 0 | 0 | 0 |
| | $d_3$ D | 0 | 0 | 0 | 0 |

Condition A: print density level = 5 or higher
Condition B: print density level = 1 to 4, or 9 to 12
Condition C: print density levels 3, 4, 7, 8, 11, 12
Condition D: print density levels 2, 4, 6, 8, 10, 12

FIG.39

Ⅳ Energize period

| current line | current line | $d_0$ A | | $\overline{d_0}$ $\overline{A}$ | |
|---|---|---|---|---|---|
| | previous line | $d_1$ B | $\overline{d_1}$ $\overline{B}$ | $\overline{d_1}$ $\overline{B}$ | $d_1$ B |
| $d_2$ C | $d_3$ D | 1 | 1 | 1 | 1 |
| | $\overline{d_3}$ $\overline{D}$ | 0 | 0 | 0 | 0 |
| $\overline{d_2}$ $\overline{C}$ | $\overline{d_3}$ $\overline{D}$ | 0 | 0 | 0 | 0 |
| | $d_3$ D | 1 | 1 | 1 | 1 |

Condition A: print density level = 5 or higher
Condition B: print density level = 1 to 4, or 9 to 12
Condition C: print density levels 3, 4, 7, 8, 11, 12
Condition D: print density levels 2, 4, 6, 8, 10, 12

FIG.40

THERMAL PRINTER

RELATED APPLICATIONS

This application is a continuation of, and claims priority under 35 U.S.C. §120 on, application Ser. No. 12/856,173, filed Aug. 13, 2010, which is a divisional of application Ser. No. 11/463,253, filed Aug. 8, 2006, now U.S. Pat. No. 7,802,857, which claims priority under 35 U.S.C. §119 on Japanese patent application no. 2005-239171, filed Aug. 19, 2005. Each of the above-identified applications is incorporated by reference herein in its entirety.

BACKGROUND OF THE INVENTION

1. Field of the Invention

The present invention relates to thermal printers, and a control method and a control program for thermal printers, in which drive signals that are applied to heating elements are changed to track stored pattern values.

2. Description of the Related Art

Thermal printers such as line thermal printers have numerous independently drivable heating elements arrayed in a row, and print by selectively driving the heating elements to emit heat and thereby cause the dot on the opposing thermal paper to change color.

The color change produced in the thermal paper depends upon the amount of heat energy applied to the thermal paper or other recording medium by the heating element. In order to print with consistent quality, the heat energy actually applied from the heating element to the recording medium must be stable.

Printing technologies that consider the recent dot history, and printing technologies that change the heat energy applied by the heating elements to thermal paper having different color layers to produce a particular desired color are also known from the literature. See, for example, Japanese Patent 2,836,584.

Printers of this type increase the pulse width of the heating element drive circuit to apply heat energy of a HIGH level to print one color, and shorten the pulse width to apply heat energy of a LOW level in order to print another color.

Printing gray scale content of just one color also requires varying the pulse width according to the density of the color to be printed.

Understanding this background, a thermal printer that can switch between what is known as a hysteresis (or dot history) control mode enabling high quality monochrome printing by referencing the recent dot history, and a print mode for printing multiple colors, is still desirable.

Plural types of logic circuits that can provide the control needed for each print mode must be provided in order to achieve this type of thermal printer, but the logic cannot be changed after manufacturing if the logic circuits for each print mode are hard wired. As a result, if an improved control method is developed after a printer is manufactured, the improved control method cannot be implemented by printers that have already been manufactured. In addition, a separate logic circuit must be provided for each print mode, and this increases the size of the printer.

SUMMARY OF THE INVENTION

Accordingly, the present invention provides a printing control unit for a thermal printer. Such control unit comprises a line buffer unit for accumulating current dot printing data supplied from a host; a shift register unit for getting and passing the current dot printing data and previous dot history data from the line buffer unit to a logic circuit unit; and a configuration registration unit for storing configuration data for setting data logic of the logic circuit unit.

Preferably, the printing control unit corrects the current dot printing data based on the previous dot history data and supplies the corrected current dot printing data to a print head unit.

Preferably, the printing control unit changes the data logic of the logic circuit unit by operation of the configuration registration unit to supply patterns for driving the print head unit based on the configuration data.

The printing control unit for a thermal printer may further comprise a node control circuit unit for switching the logic circuit unit to output data to the print head unit; and a sequencer unit for controlling the sequence of the shift register unit, the logic circuit unit, and the node control circuit unit.

Implementations of the functionality of the printing control unit may be embodied in methods or processor-executable control programs contained on non-transitory device- or computer-readable mediums.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 6 describes the meaning of each bit in a register used for three-stage hysteresis control of monochrome printing;

FIG. 7 describes the meaning of each bit in a register used for two-color control;

FIG. 11 describes the register settings of the first logic circuit during single-stage hysteresis control of monochrome printing;

FIG. 18 is an equivalent circuit diagram of the first logic circuit during two-color printing control;

FIG. 19 describes the register settings of the first logic circuit during two-color printing control;

FIG. 20 is an equivalent circuit diagram of the second logic circuit during two-color printing control;

FIG. 21 describes the register settings of the second logic circuit during two-color printing control;

FIG. 26 describes the register settings of the first logic circuit in another example of two-color printing control;

FIG. 27 describes the register settings of the second logic circuit in another example of two-color printing control;

FIG. 28 describes the register settings of the third logic circuit in another example of two-color printing control;

FIG. 29 describes the register settings of the fourth logic circuit in another example of two-color printing control;

FIG. 32 describes the register settings of the first logic circuit during single-stage hysteresis control of gray scale printing;

FIG. 33 describes the register settings of the second logic circuit during single-stage hysteresis control of gray scale printing;

FIG. 34 describes the register settings of the third logic circuit during single-stage hysteresis control of gray scale printing;

FIG. 35 describes the register settings of the fourth logic circuit during single-stage hysteresis control of gray scale printing;

FIG. 36 describes thirteen-level gray scale control of gray scale printing;

FIG. 37 describes the register settings of the first logic circuit during thirteen-level gray scale control of gray scale printing;

FIG. 38 describes the register settings of the second logic circuit during thirteen-level gray scale control of gray scale printing;

FIG. 39 describes the register settings of the third logic circuit during thirteen-level gray scale control of gray scale printing; and FIG. 40 describes the register settings of the fourth logic circuit during thirteen-level gray scale control of gray scale printing.

DESCRIPTION OF THE PREFERRED EMBODIMENTS

Preferred embodiments of the present invention are described below with reference to the accompanying figures.

Figure 1:
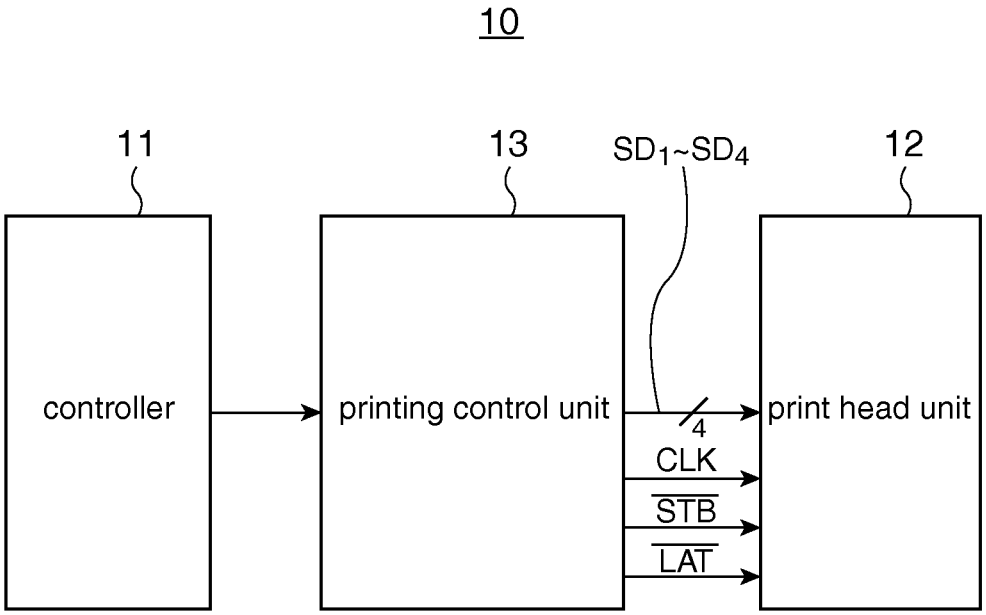
FIG. 1 is a schematic diagram of a line thermal printer according to a preferred embodiment of the invention.

FIG. 1 is a schematic diagram of a line thermal printer according to a preferred embodiment of the invention.

This line thermal printer 10 has a controller 11 for controlling the line thermal printer 10, a print head unit 12 that does the actual printing and a printing control unit 13 that is controlled by the controller 11 and controls the print head unit 12.

The controller 11 is a microcomputer comprising an MPU not shown, ROM not shown for storing control programs, and RAM not shown for temporarily storing data.

Figure 2:
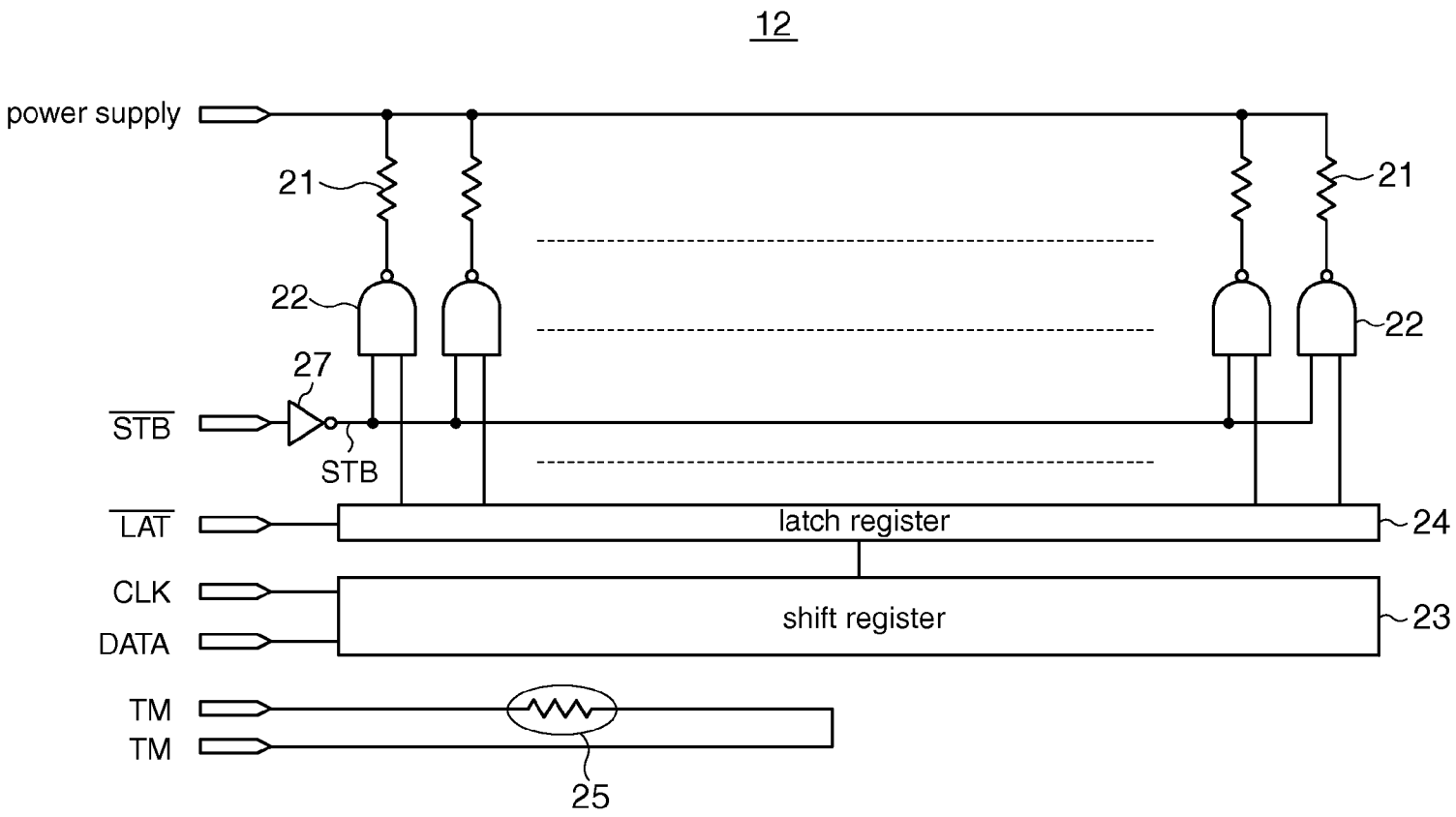
FIG. 2 is a schematic diagram of the print head unit.

FIG. 2 is a schematic block diagram of the print head unit.

The print head unit 12 has a large number of heating elements (resistances) 21 for simultaneously printing one line of print data (dots). The heating elements 21 are arrayed on the distal edge of the print head unit 12, which is rendered across the width of the thermal paper used as the recording medium, and simultaneously print one line of pixels on the thermosensitive recording medium (the thermal paper) by selectively driving the heating elements 21 to heat. Numerous drive circuits 22 for independently thermally driving the heating elements 21 are connected to the controller 21.

The drive circuits 22 can be bipolar transistors (pnp or npn) or MOS transistors (n-channel MOS or p-channel MOS), but are not so limited. Selectively driving a particular drive circuit 22 causes the corresponding drive circuit 22 to heat, thereby causing the dot at the corresponding position on the thermal paper to change color.

The drive circuits 22 are shown as NAND devices in FIG. 2 in order to describe the logic operation of the drive circuits 22. More specifically, when the inverted strobe signal /STB is inactive (HIGH), operation of the corresponding drive circuit 22 is prohibited. This drive circuit 22 can be easily rendered by connecting a data signal DATA and the inverted strobe signal /STB (positive logic) to the base of a pnp transistor in a wired OR arrangement.

An inverter 27 inverts the inverted strobe signal /STB (negative logic) so that strobe signal STB and the print data DATA (positive logic) signal are input to the drive circuits 22, which are thus driven based on the level of each signal.

More specifically, when a "1" meaning to print the dot is applied as the print dot data, the inverted strobe signal /STB is inverted from HIGH to LOW, thus enabling driving and causing the NAND drive circuit 22 to output LOW. This produces a potential difference to the head voltage in the corresponding heating element, thereby causing the heating element to heat and change the color of the dot at the corresponding position on the thermal paper. The pulse width of the inverted strobe signal /STB supplied in one pulse period may be one of four different pulse widths 1 to 4.

To temporarily store the printing data for one printing line, the print head unit 12 rendered in the line thermal printer 10 according to this embodiment of the invention has a shift register 23 and a latch register 24.

The print data DATA for one line is input to the shift register 23 synchronized to the clock signal CLK and held. This print data DATA is the data corresponding to each pixel (dot) on one line, but more accurately is data indicating whether each dot is energized or not in the period corresponding to a particular line, and is therefore a bit train wherein "1" means "energize" (drive) and "0" means "do not energize" (do not drive). As further described below, the result of a specific operation executed using the current print dot data and the previous print data DATA is input every predetermined energize (drive) period to the shift register 23 in this embodiment of the invention.

The latch register 24 is parallel connected to the shift register 23, and each data bit in the shift register 23 is simultaneously parallel transferred to the corresponding storage area and held. As a result, the print data DATA for the next drive period can be input to the shift register 23 while the drive circuits 22 are driven to print in one energize period.

The transfer timing of the print data DATA from the shift register 23 to the latch register 24 is controlled according to the input timing of the latch signal /LAT output from the printing control unit 13 to the latch register 24. The input timing of this latch signal /LAT is after one drive period and before the next drive period, and is also after the print data DATA for the next drive period is written to the shift register 23.

As further described below, each storage area in the latch register 24 is connected to one input pin of the drive circuit 22. When the latch signal /LAT input triggers the latch register 24 to fetch new data, the input data to the drive circuit 22 immediately changes accordingly. When the inverted strobe signal /STB applied to a particular drive circuit 22 is LOW (active), the drive circuit 22 is energized and drives the corresponding heating element 21 based on the print data DATA in the latch register 24.

The print head unit 12 also has a thermistor 25 for measuring the temperature of the print head unit 12, thus enabling knowing the temperature of the print head, which is one factor determining the pulse width, and enabling control preventing the temperature of the print head unit 12 from rising higher than needed (not only for control when a problem occurs).

Figure 3:
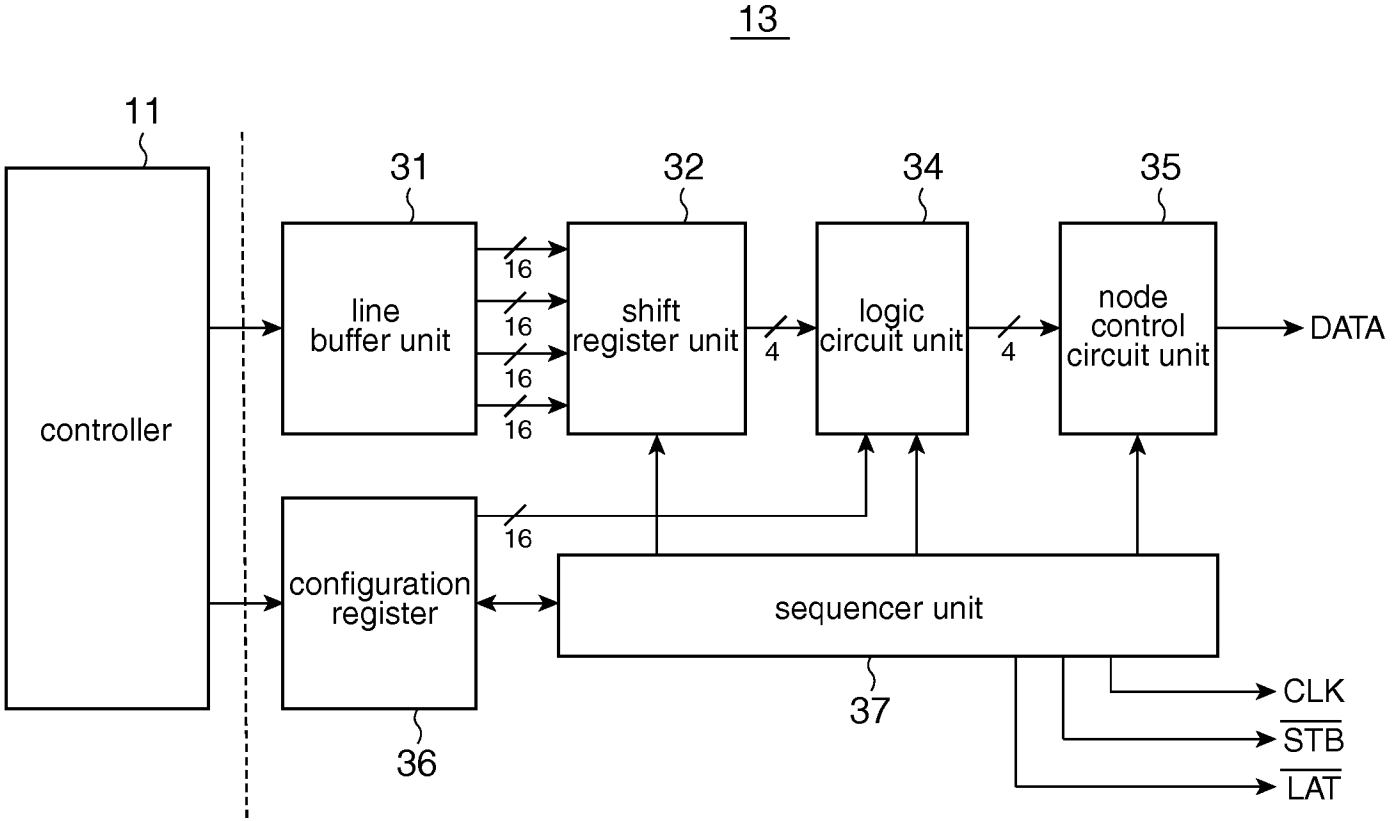
FIG. 3 is a schematic diagram of the printing control unit.

FIG. 3 is a schematic block diagram of the printing control unit.

The printing control unit 13 basically corrects the print dot data received from the host based on the recent dot history, and applies the corrected print dot data to the print head unit 12.

The printing control unit 13 has a line buffer unit 31 for storing the print dot data, a shift register unit 32, a logic circuit unit 34, a node control circuit unit 35, a configuration register 36, and a sequencer unit 37 for cooperatively controlling the operating timing of the shift register unit 32, logic circuit unit 34, node control circuit unit 35, and print head unit 12.

The shift register unit 32 fetches dot history data including the print dot data for the current line locally from the line buffer unit 31, and passes the dot history data to the logic circuit unit 34.

The logic circuit unit 34 comprises the same number of logic circuits as there are energize levels, and based on the operating mode each logic circuit can dynamically set the data logic used to actually drive the print head unit 12 based on the output from the shift register unit 32.

The node control circuit unit 35 changes the circuits of the logic circuit unit 34, that is, the data output to the head, every drive period according to the sequence specified by the sequencer unit 37.

The configuration register 36 stores settings data, including the data for dynamically setting the data logic of the logic circuit unit 34.

The actual circuitry can be rendered in various ways, including as a thermal print head circuit enabling input on plural data lines, a segmented control circuit that prints by dividing one line into multiple blocks to afford compatibility with a low capacitance power supply, and circuits affording various other additional functions. Describing the design of such circuits is even more complex and not essential to the present invention, and further description thereof is therefore omitted.

This line thermal printer 10 can be driven to operate as a monochrome printer that prints black, or a two-color printer that prints black and red or black and blue, for example, by changing the operating mode configuration. Details of this printer control are described below with reference to the accompanying figures.

Figure 4:
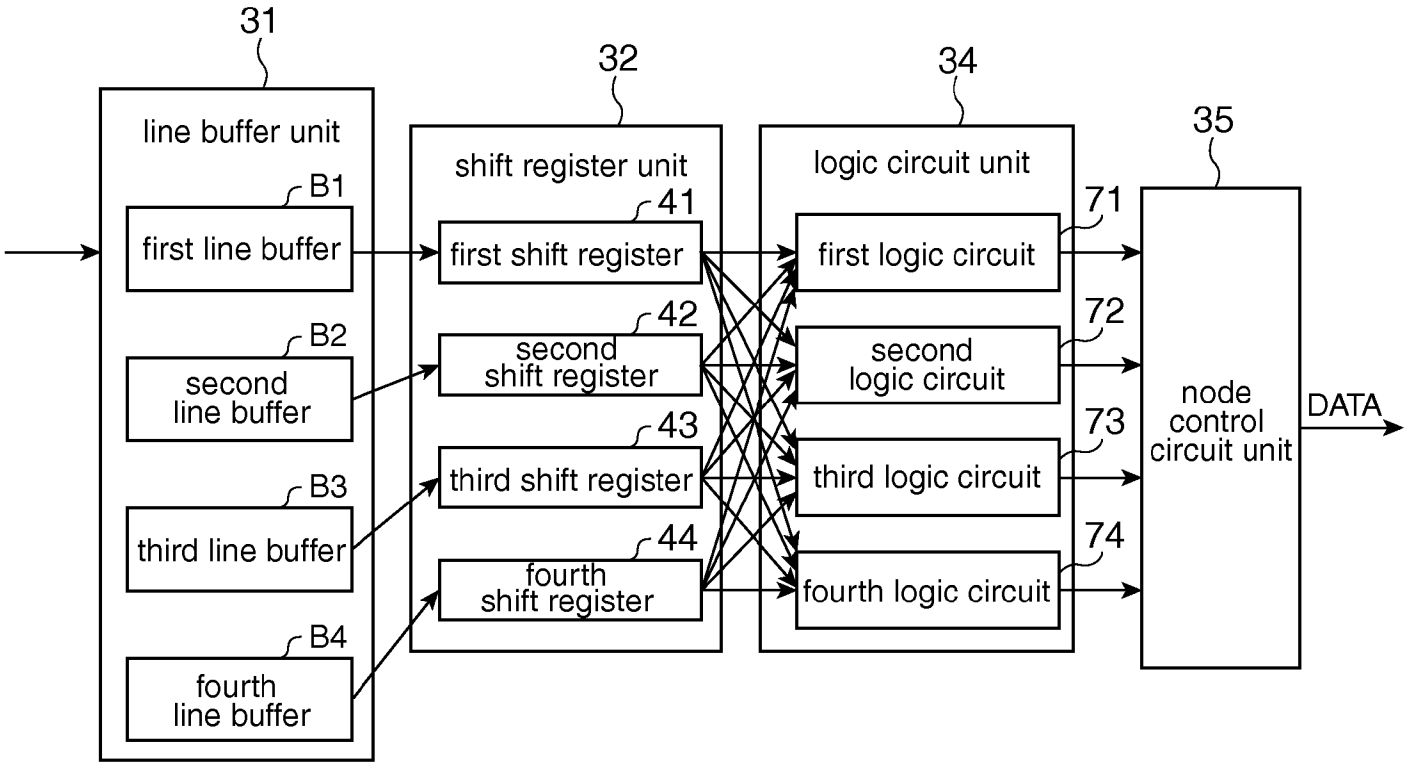
FIG. 4 is a schematic diagram of the printing control unit.

FIG. 4 is a detailed block diagram of the printing control unit.

As shown in the figure, the line buffer unit 31 of the printing control unit 13 is logically divided into separate storage areas identified as four line buffers B1 to B4. These line buffers can be rendered using one or a plurality of RAM devices. To simplify address control, this embodiment of the invention uses four physically discrete SRAM (static RAM) devices.

The print dot data train received by a reception circuit not shown from a host device (such as an external personal computer) passes through the controller 11 and is temporarily stored in one of the first to fourth line buffers B1-B4.

The line thermal printer 10 has two print modes, a single-color print mode that prints black (the "monochrome mode" below) and a two-color printing mode that prints black and red (the "two-color mode" below). The two-color mode expresses intermediate energy levels and can therefore also be used for gray scale printing of a single color, but is described below as printing black and red. Which print mode is active can be set using a physical configuration means such as a DIP switch disposed to the printer, or by a command sent from the host device.

The print mode can also be set according to a control command received from the host device. In this case, the print mode setting is stored at a predetermined address in RAM, nonvolatile memory, or other storage device, and is read from this address when a printing process is called.

When the print mode of the line thermal printer 10 is set to the monochrome mode, the first line buffer B1 stores the data train for the dots to be printed next (such as the dot data for one line), and the other three line buffers B2 to B4 store the print dot data trains for the last three lines printed (the hysteresis data).

For example, the print dot data for the current line d0 is stored to line buffer B1, the print dot data for the previous line d1 is stored to line buffer B2, the dot data d2 for the line before the previous line (i.e., two lines before the current line) is stored to line buffer B3, and the dot data d3 for the line before the line before the previous line (i.e., three lines before the current line) is stored in line buffer B4.

When printing the current line ends, dot data d3 is deleted, and dot data d2 is logically transferred from line buffer B3 to line buffer B4 and used as dot data d3 in the next printing process. Physically transferring the data is not practical due to time considerations, and logically transferring the data here means that the address lines are controlled so that the buffers are read in the order the data would be read if the data was physically transferred.

After printing one line ends, dot data d1 is likewise logically transferred from line buffer B2 to line buffer B3 and handled as dot data d2 in the next printing process, and dot data d0 is logically transferred from line buffer B1 to line buffer B2 and handled as dot data d1 in the next printing process.

When the print mode of the line thermal printer 10 is set to the two-color mode, a print dot data train for black dots and a print dot data train for red dots are sequentially sent from the host. More specifically, signals controlling whether black or red prints are stored to separate buffers. In this embodiment of the invention line buffers B1 and B2 are used for black dots with line buffer B1 storing the current black print dot data and line buffer B2 storing the black print dot data for the previous line. Likewise, line buffers B3 and B4 are used for red dots with line buffer B3 storing the current red print dot data and line buffer B4 storing the red print dot data for the previous line.

More specifically, if dot data d0 is the black print dot data for the current line, dot data d1 is the black dot data for the previous line, dot data d2 is the red dot data for the current line, and dot data d3 is the red dot data for the previous line, the current black dot data d0 is stored to line buffer B1, the previous black dot data d1 is stored to line buffer B2, the current red dot data d2 is stored to line buffer B3, and the previous red dot data d3 is stored to line buffer B4.

The controller 11 handles storing the dot data to line buffers B1 to B4. More specifically, the controller 11 executes a control program stored in ROM not shown to function as a memory allocation circuit, and controls storing the dot data to the line buffers as described above according to the currently set print mode. The line buffer unit 31 controls data transfers between the line buffers B1 to B4 according to the mode setting.

The shift register unit 32 comprises a first shift register 41 for first line buffer B1, a second shift register 42 for second line buffer B2, a third shift register 43 for third line buffer B3, and a fourth shift register 44 for fourth line buffer B4.

The first shift register 41 to fourth shift register 44 store the dot data d1 to d4 described above. Operationally, the data stored in the line buffer unit 31 is read in address blocks (a 16 dot unit because the address is 16 bits wide in this embodiment of the invention) and the shift registers shift synchronized to the print head transfer clock generated by the sequencer unit 37. When transferring the 16 dots ends, this operation repeats to read and shift the 16 dots of data at the next address in the line buffer.

The logic circuit unit 34 of the printing control unit 13 comprises the first logic circuit 71 to fourth logic circuit 74 used for monochrome printing and two-color printing.

The first logic circuit 71 to fourth logic circuit 74 are identically configured, and first logic circuit 71 is therefore described by way of example below.

Figure 5:
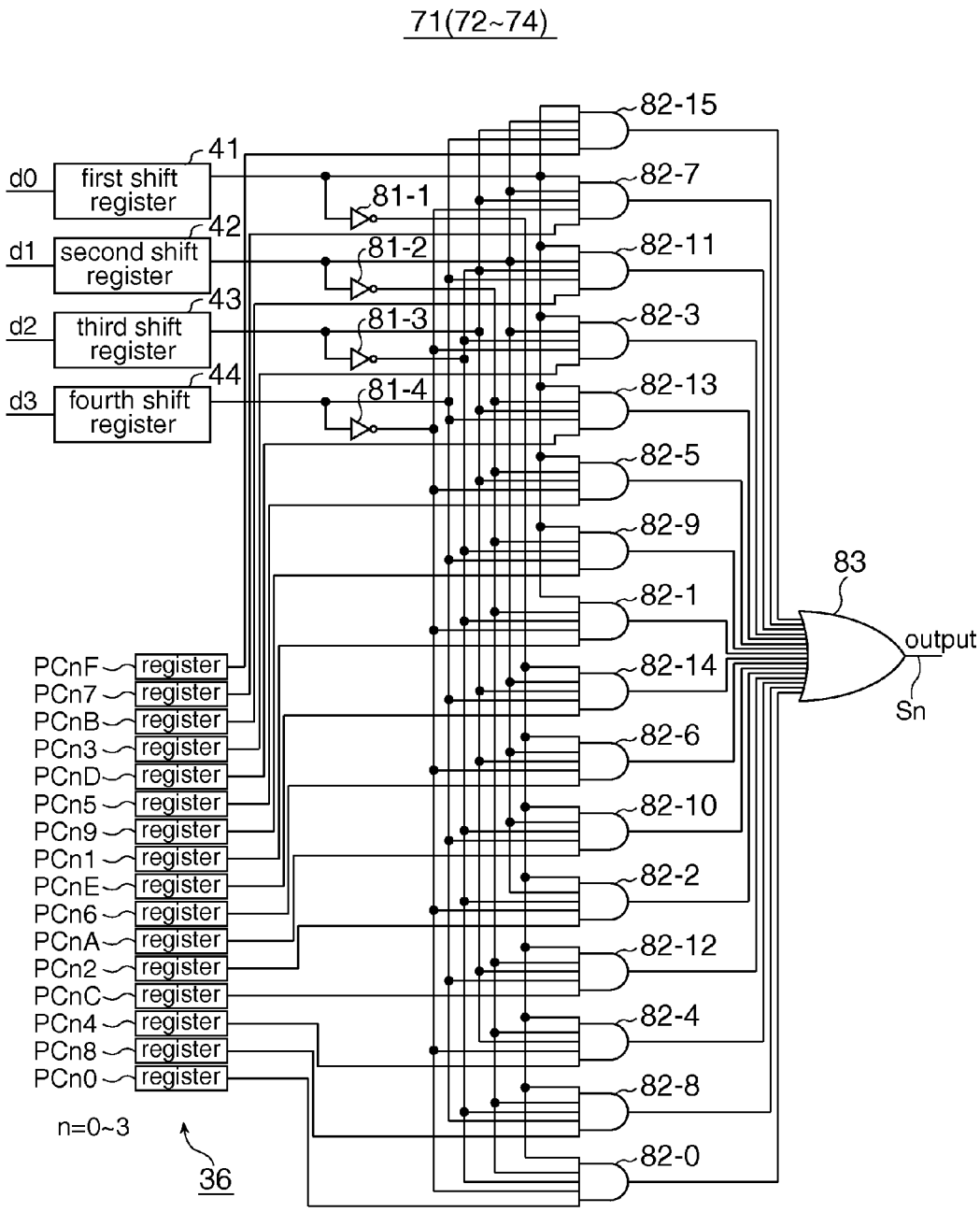
FIG. 5 is a logic circuit block diagram of the first through fourth logic circuits.

FIG. 5 is a block diagram of a logic circuit used as the first logic circuit 71 to the fourth logic circuit 74.

This first logic circuit 71 has four inverters 81-1 to 81-4, sixteen five-input AND circuits 82-0 to 82-15 corresponding to the 16 bits, and a 16-input OR circuit 83.

Registers PCn0 to PCnF are connected to one input node of each of the AND circuits 82-0 to 82-15.

The output of first shift register 41 is connected to AND circuits 82-15, 82-7, 82-11, 82-3, 82-13, 82-5, 82-9, 82-1, and inverter 81-1.

The output of second shift register 42 is connected to AND circuits 82-15, 82-7, 82-11, 82-3, 82-14, 82-6, 82-10, 82-1, and inverter 81-2.

The output of third shift register 43 is connected to AND circuits 82-15, 82-7, 82-13, 82-5, 82-14, 82-6, 82-12, 82-4, and inverter 81-3.

The output of fourth shift register 44 is connected to AND circuits 82-15, 82-11, 82-13, 82-9, 82-14, 82-10, 82-12, 82-8, and inverter 81-4.

The output of inverter 81-1 is connected to AND circuits 82-0, 82-2, 82-4, 82-6, 82-8, 82-10, 82-12, 82-14.

The output of inverter 81-2 is connected to AND circuits 82-0, 82-1, 82-4, 82-5, 82-8, 82-9, 82-12, 82-13.

The output of inverter 81-3 is connected to AND circuits 82-1, 82-2, 82-3, 82-4, 82-8, 82-9, 82-10, 82-11.

The output of inverter 81-4 is connected to AND circuits 82-0, 82-1, 82-2, 82-3, 82-4, 82-5, 82-6, 82-7.

The configuration register 36 comprises 16 registers PCn0 to PCnF for each of the first to fourth drive periods, and thus has a total 64 registers. More specifically, the configuration register 36 has 64 registers including registers PC30 to PC3F for the first drive period, registers PC20 to PC2F for the second drive period, registers PC10 to PC1F for the third drive period, and registers PC00 to PC0F for the fourth drive period.

The logic output Sn of the first to fourth logic circuits 71-74 is expressed using dot data d0 to d3 as shown in equation 1.

$$\begin{aligned} S_n = {} & PC_{n0} * /d_3 * /d_2 * /d_1 * /d_0 + PC_{n1} * /d_3 * /d_2 * /d_1 * d_0 + \\ & PC_{n2} * /d_3 * /d_2 * d_1 * /d_0 + PC_{n3} * /d_3 * /d_2 * d_1 * d_0 + \\ & PC_{n4} * /d_3 * d_2 * /d_1 * /d_0 + PC_{n5} * /d_3 * d_2 * /d_1 * d_0 + \\ & PC_{n6} * /d_3 * d_2 * d_1 * /d_0 + PC_{n7} * /d_3 * d_2 * d_1 * d_0 + \\ & PC_{n8} * d_3 * /d_2 * /d_1 * /d_0 + PC_{n9} * d_3 * /d_2 * /d_1 * d_0 + \\ & PC_{nA} * d_3 * /d_2 * d_1 * /d_0 + PC_{nB} * d_3 * /d_2 * d_1 * d_0 + \\ & PC_{nC} * d_3 * d_2 * /d_1 * /d_0 + PC_{nD} * d_3 * d_2 * /d_1 * d_0 + \\ & PC_{nE} * d_3 * d_2 * d_1 * /d_0 + PC_{nF} * d_3 * d_2 * d_1 * d_0 \end{aligned} \quad \text{Eq. 1}$$

As will be known from equation 1, any value of 0 in registers PCn0 to PCnF is 0 regardless of the corresponding logic value (d0 to d3 and the inverted /d0 to /d3), and has no effect on the logic output Sn.

The meaning of the logic output Sn (n=1 to 4) and each bit (16 bits) in register PCn is described below for three-stage hysteresis control of monochrome printing and two-color printing.

FIG. 6 describes the meaning of each bit in the registers for three-stage hysteresis control of monochrome printing.

In FIG. 6 bX (where X=0–Fh (h denotes hexadecimal)) is one bit in registers PCn0 to PCnF.

For example, in equation 1 the logic values corresponding to bit b0 are the four values /d0 to /d3. The logic values corresponding to bit b8 are the four values /d0 to /d2 and d3. The logic values corresponding to bit b15 are the four values d0 to d3.

The meaning of each bit (16 bits) in register PCn and logic output Sn (n=1 to 4) in three-stage hysteresis control of monochrome printing is described below.

FIG. 7 describes the meaning of each bit in the register during two-color printing.

Logic values d0 and d0 denote black, logic values /d0 and /d1 denote red or non-printing, logic values d2 and d3 denote red (black), and logic values /d2 and /d3 denote black or non-printing.

In FIG. 7 bX (where X=0–Fh (h denotes hexadecimal)) is one bit in registers PCn0 to PCnF.

For example, in equation 1 the logic values corresponding to bit b0 are the four values /d0 to /d3. The logic values corresponding to bit b8 are the four values /d0 to /d2 and d3. The logic values corresponding to bit b15 are the four values d0 to d3.

The operation of this embodiment of the invention is described next.

(1) Control in One-Stage Hysteresis Control of Monochrome Printing

Control in one-stage hysteresis control of monochrome printing is described first below.

One-stage hysteresis control of monochrome printing refers to controlling monochrome printing with reference only to the print data for the previous line (one-stage hysteresis control).

For simplicity below, the energize (drive) period is not segmented and there is only one output to the print head unit 12.

Figure 8:
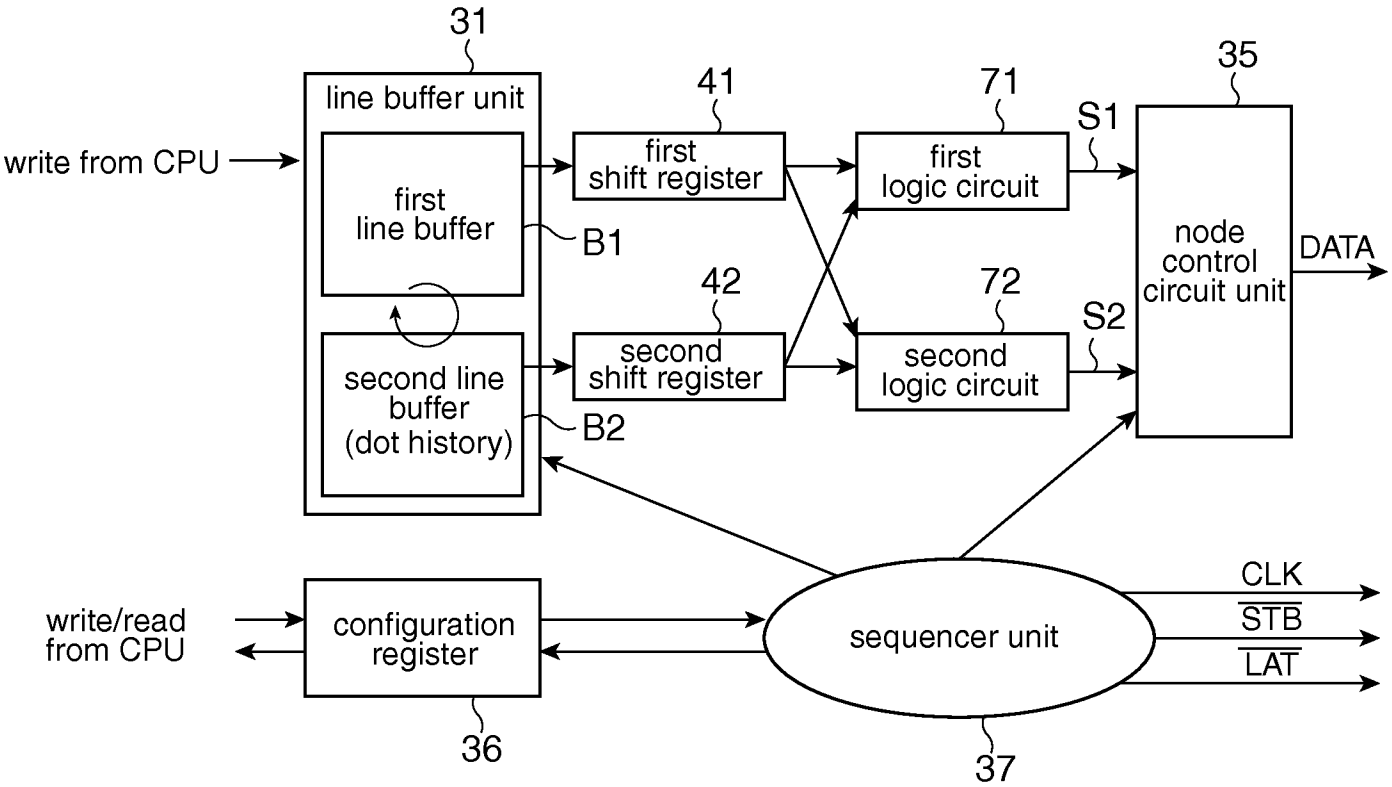
FIG. 8 is a schematic diagram of the main parts used for single-stage hysteresis control of monochrome printing.

FIG. 8 is a schematic block diagram of the arrangement used for single-stage hysteresis control of monochrome printing.

For single-stage hysteresis control of monochrome printing the line buffer unit 31 uses the first line buffer B1 (to store the current dot data d0) and second line buffer B2 (to store the previous dot data d1), and dot data d0 is transferred to the first shift register 41 and dot data d1 is transferred to the second shift register 42.

Figure 9:
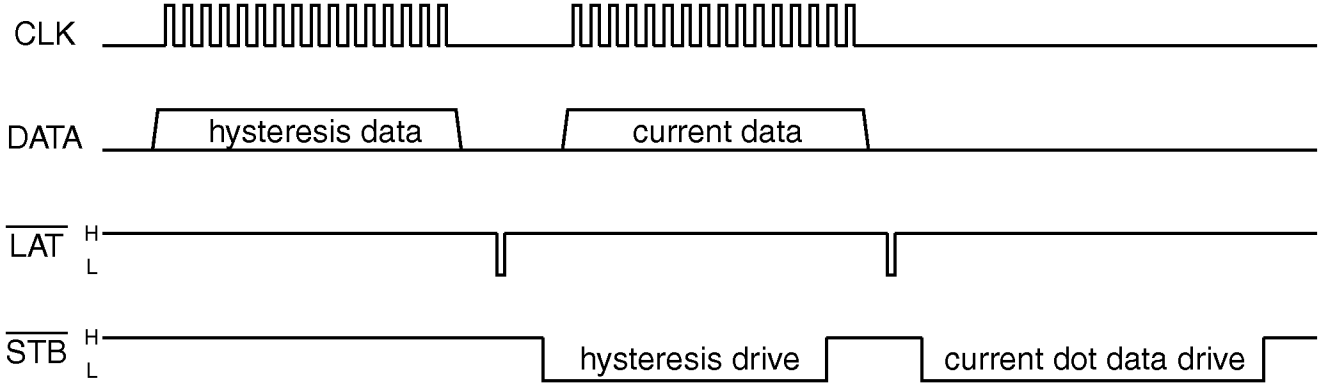
FIG. 9 is a timing chart of single-stage hysteresis control of monochrome printing.

FIG. 9 is a timing chart of single-stage hysteresis control for monochrome printing.

The dot data d0 stored in first shift register 41 and the dot data d1 stored in second shift register 42 is sequentially transferred to the first logic circuit 71 and second logic circuit 72, respectively, based on the clock signal CLK output by the sequencer unit 37 as shown in FIG. 9.

The first logic circuit 71 uses a logic operation to generate hysteresis data for driving the print head (hysteresis drive) based on the dot history of the last line, that is, based on dot data d1, and outputs the hysteresis data through the node control circuit unit 35 to the shift register 23 of the print head unit 12.

When the latch signal /LAT then goes LOW, the hysteresis data stored in shift register 23 is transferred to the latch register 24, and when the strobe signal /STB goes LOW, the drive circuit 22 corresponding to the hysteresis data drives the heating element 21 to print.

Parallel to this operation the second logic circuit 72 applies a logic operation to generate the current drive data for the current line based on the current dot data d0, and transfers the drive data through the node control circuit unit 35 to the shift register 23 of the print head unit 12.

When the latch signal /LAT then goes LOW, the current drive data stored in shift register 23 is transferred to the latch register 24, and when the strobe signal /STB goes LOW, the drive circuit 22 corresponding to the hysteresis data drives the heating element 21 to print.

Figure 10:
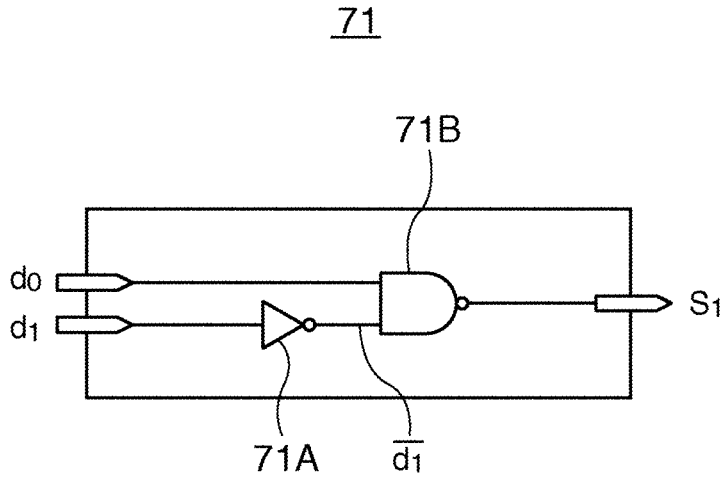
FIG. 10 is an equivalent circuit diagram of the first logic circuit.

FIG. 10 is an equivalent circuit diagram of the first logic circuit.

When dot data d0 and dot data d1 are input, the logical product of the logic value of dot data d0 and the logic value of the inverted dot data /d1, which is the logic of dot data d1 inverted by the inverter circuit 71A (NOT circuit), is acquired by AND circuit 71B, and output as output logic S1.

FIG. 11 describes the register settings of the first logic circuit during single-stage hysteresis control of monochrome printing.

During single-stage hysteresis control for monochrome printing, register PC3D, register PC35, register PC39, and register PC31 in first logic circuit 71 are set to 1, and the other registers are set to 0, as shown in FIG. 11.

Figure 12:
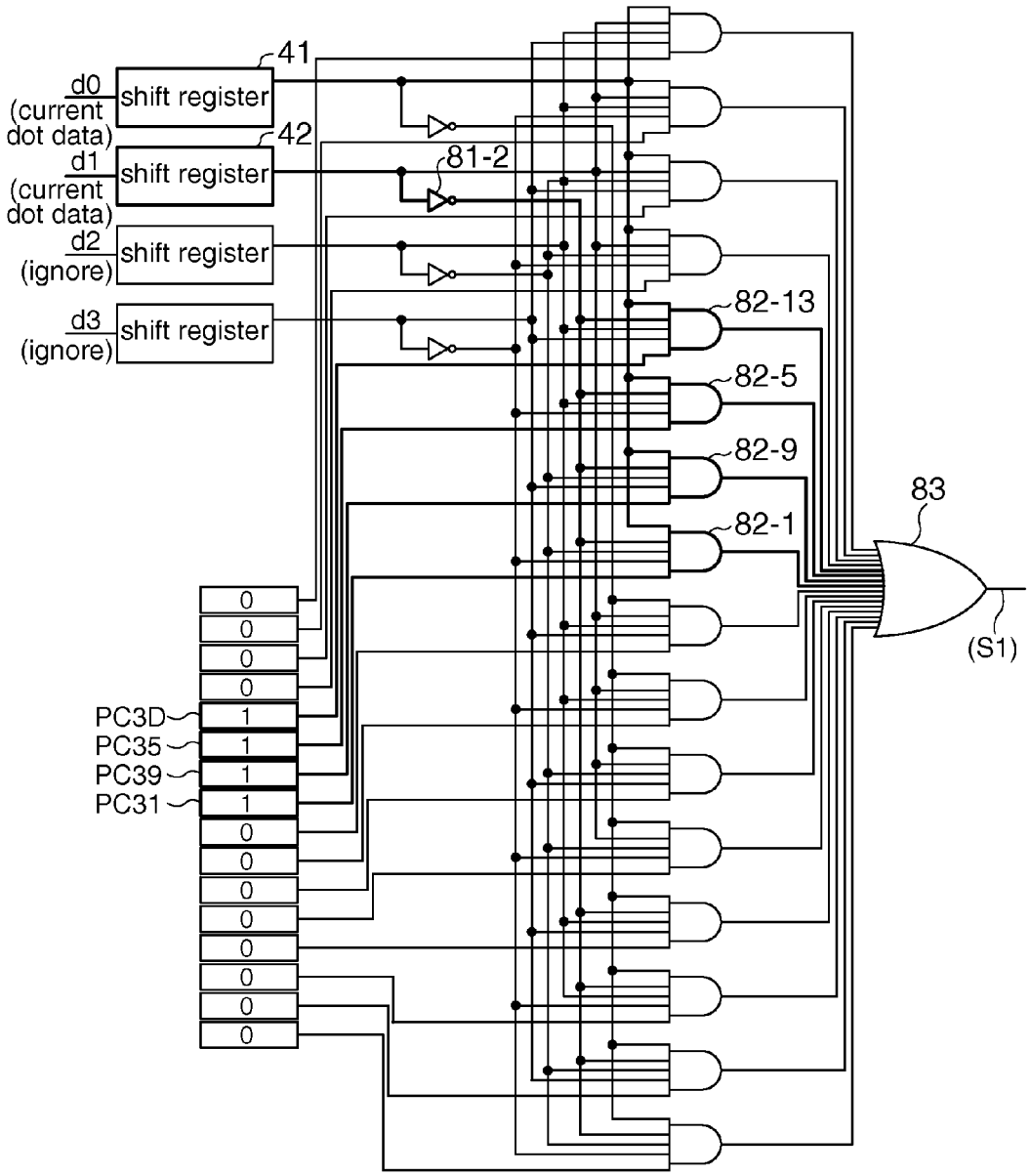
FIG. 12 describes the operating states of the first logic circuit.

FIG. 12 describes the operating states of the first logic circuit.

As indicated by the bold lines in FIG. 12, the only elements of the first logic circuit 71 that actually operate at this time are inverter 81-1 and AND circuits 82-13, 82-5, 82-9, and 82-1.

Figures 13, 14:
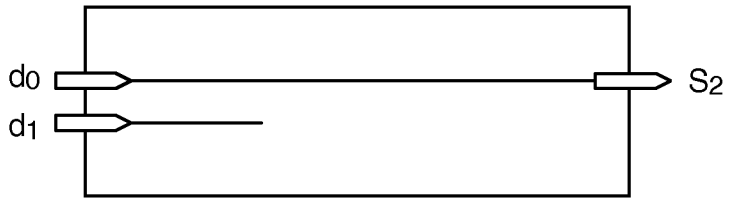
FIG. 13 is an equivalent circuit diagram of the second logic circuit.
FIG. 14 describes the register settings of the second logic circuit during single-stage hysteresis control of monochrome printing.

FIG. 13 is an equivalent circuit diagram of the second logic circuit.

When dot data d0 and dot data d1 are input, the logic value of dot data d0 is output as output logic S2.

FIG. 14 describes the register settings of the second logic circuit during single-stage hysteresis control of monochrome printing.

During single-stage hysteresis control for monochrome printing, register PC2F, register PC27, register PC2B, register PC23, register PC2D, register PC25, register PC29, and register PC21 in second logic circuit 72 are set to 1, and the other registers are set to 0, as shown in FIG. 14.

Figure 15:
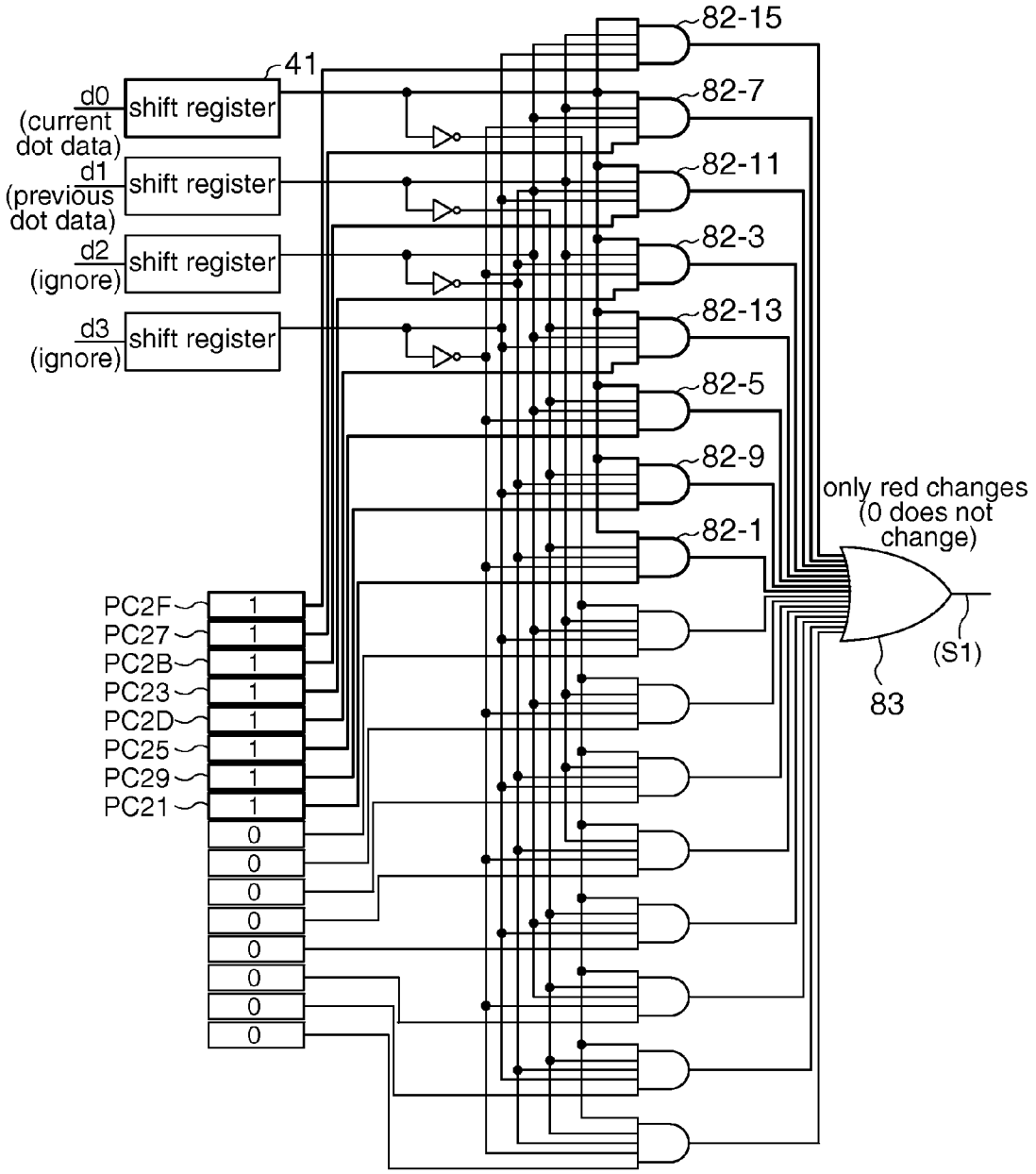
FIG. 15 describes the operating states of the second logic circuit.

FIG. 15 describes the operating states of the second logic circuit.

As indicated by the bold lines in FIG. 15, the only elements of the second logic circuit 72 that actually operate at this time are AND circuits 82-15, 82-7, 82-11, 82-3, 82-13, 82-5, 82-9, and 82-1.

(2) Two-Color Printing Control

Two-color printing control is described next. It is assumed below that red is printed when the energize (drive) time is short, that is, the temperature of the thermal paper is low, and black is printed after passing through a red print stage when the energize (drive) time is long, that is, the temperature of the thermal paper is high.

Figure 16:
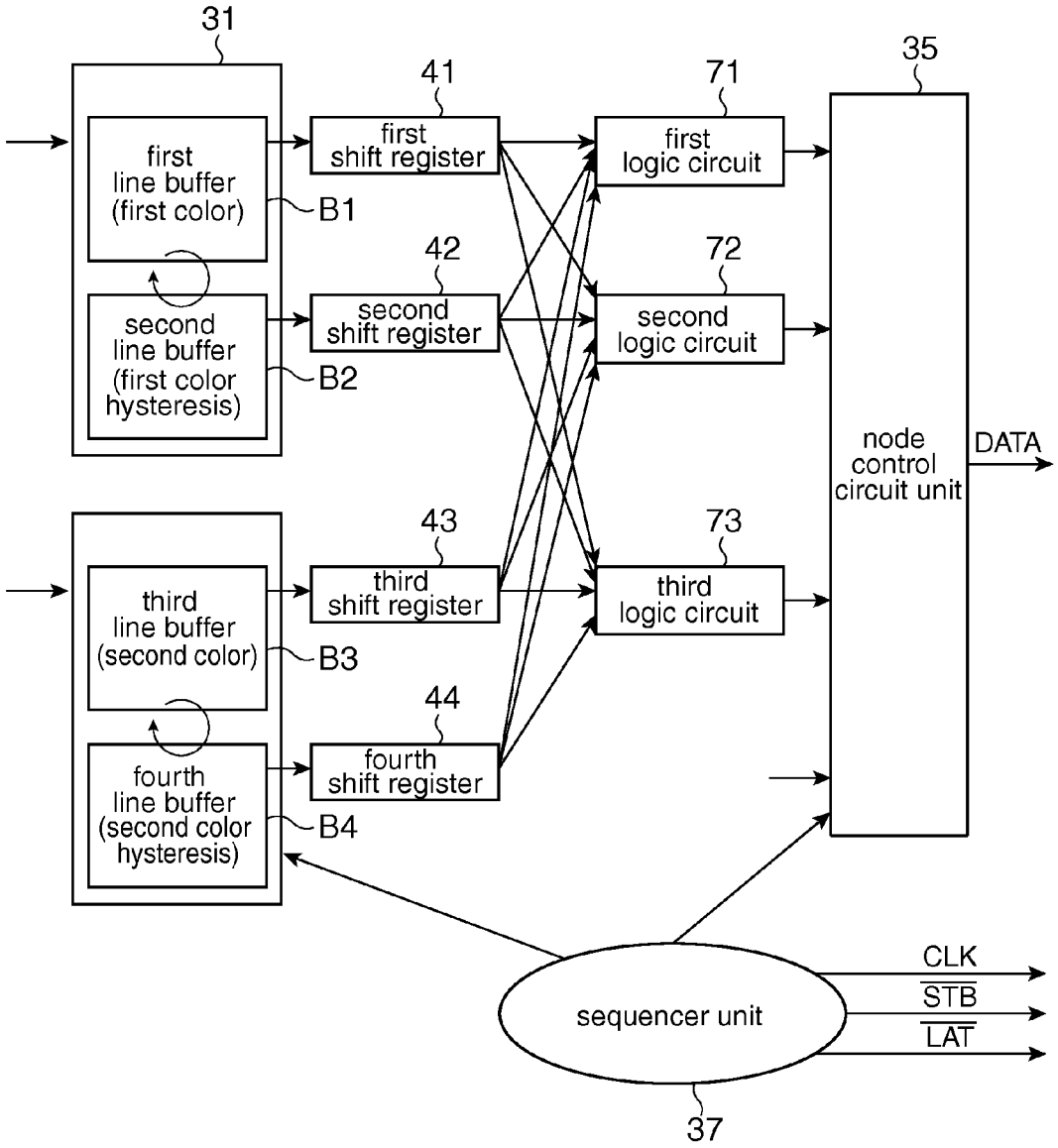
FIG. 16 is a schematic diagram of two-color printing control.

FIG. 16 is a schematic diagram of two-color printing control.

When operating in the two-color printing mode, the first line buffer B1 (for storing the current black dot data d0), the second line buffer B2 (for storing the previous black dot data d1), the third line buffer B3 (for storing the current red dot data d2), and the fourth line buffer B4 (for storing the previous red dot data d3) of the line buffer unit 31 are used. In addition, dot data d0 is transferred to the first shift register 41, dot data d1 is transferred to the second shift register 42, dot data d2 is transferred to the third shift register 43, and dot data d3 is transferred to the fourth shift register 44.

As shown in FIG. 16, the dot data d0 stored in first shift register 41, the dot data d1 stored in second shift register 42, the dot data d2 stored in third shift register 43, and the dot data d3 stored in fourth shift register 44 is sequentially transferred to first logic circuit 71, second logic circuit 72, and third logic circuit 73, respectively, based on the clock signal CLK output by the sequencer unit 37.

The first logic circuit 71 therefore generates the first drive data I as print data DATA for the first drive period from a logic operation based on the current black dot data d0, the current red dot data d2, and the previous red dot data d3, and transfers the first drive data I through the node control circuit unit 35 to the shift register 23 of the print head unit 12.

When the latch signal /LAT then goes LOW, the first drive data I stored in shift register 23 is transferred to latch register 24, and when the inverted strobe signal /STB goes LOW, the drive circuit 22 corresponding to the first drive data I drives the heating element 21 to print.

Parallel to printing the first drive data I, the second logic circuit 72 generates the second drive data II for the second drive period from a logic operation on the current black dot data d0, the previous black dot data d1, and the current red dot data d2, and transfers the second drive data II through the node control circuit unit 35 to the shift register 23 of the print head unit 12.

When the latch signal /LAT then goes LOW, the second drive data II stored in the shift register 23 is transferred to the latch register 24, and when the inverted strobe signal /STB goes LOW, the drive circuit 22 corresponding to the second drive data II drives the heating element 21 to print.

Parallel to printing the second drive data II, the third logic circuit 73 generates the third drive data III for the third drive period based on the current black dot data d0, and transfers the third drive data III through the node control circuit unit 35 to the shift register 23 of the print head unit 12.

When the latch signal /LAT then goes LOW, the third drive data III stored in the shift register 23 is transferred to the latch register 24, and when the inverted strobe signal /STB goes LOW, the drive circuit 22 corresponding to the third drive data III drives the heating element 21 to print.

A specific drive pattern is described next.

Figure 17:
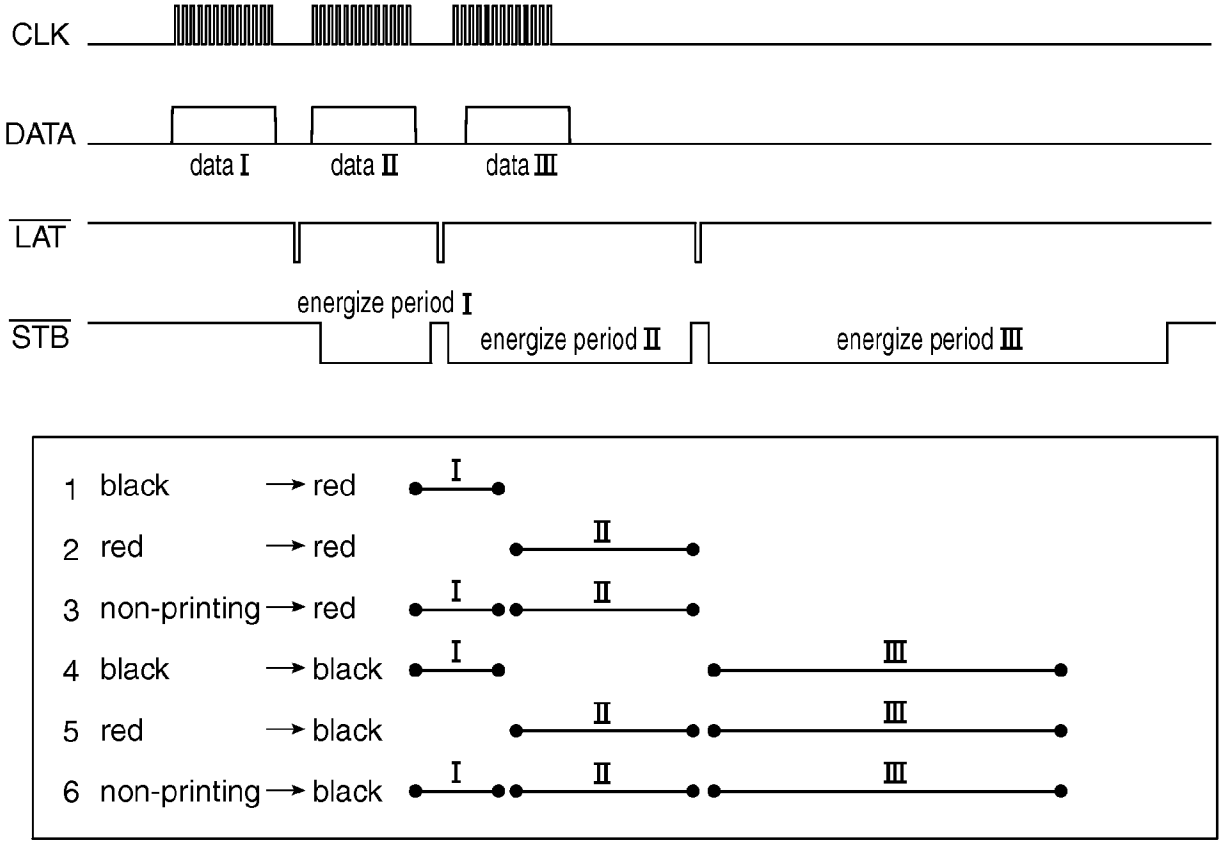
FIG. 17 describes the energizing pattern for two-color printing control.

FIG. 17 describes the energizing pattern for two-color printing control.

If the previously color printed by a particular dot was black and the current color is red, the heating element is energized only during the first drive period. That is, the drive period is the shortest drive period.

If the previously color printed was red and the current color is also red, the heating element is energized only during the second drive period.

If the previously color printed was blank (i.e., the dot did not print) and the current color is red, the heating element is energized during the first drive period and the second drive period.

If the previously color printed was black and the current color is black, the heating element is energized during the first drive period and the third drive period.

If the previously color printed was red and the current color is black, the heating element is energized during the second drive period and the third drive period.

If the previously color printed was blank (i.e., the dot did not print) and the current color is black, the heating element is energized during the first drive period, the second drive period, and the third drive period. That is, the drive period is the longest.

FIG. 18 is an equivalent circuit diagram of the first logic circuit during two-color printing control.

When dot data d0, dot data d1, and dot data d3 are input to first logic circuit 71, an OR circuit outputs the logical sum of the logic values of dot data d0 and dot data d1, an inverter (NOT gate) inverts dot data d3 and outputs inverted dot data /d3, and an AND outputs the logical product of the logical sum output by the OR gate and the logical value of the inverted /dot data d3. The AND gate outputs logic value I.

FIG. 19 describes the register settings of the first logic circuit during two-color printing control.

To implement the operation described above, register PC27, register PC23, register PC25, register PC21, register PC24, and register PC26 in the first logic circuit 71 are set to "1" and the other registers are set to 0 as shown in FIG. 19.

FIG. 20 is an equivalent circuit diagram of the second logic circuit during two-color printing control.

When dot data d0, dot data d1, and dot data d2 are input to the second logic circuit 72, OR gate 72A outputs the logical sum of the logic values of dot data d0 and dot data d2, inverter (NOT gate) 72B inverts the dot data d1 and outputs inverted dot data /d1, and AND gate 72C obtains the logical product of inverted dot data /d1 and the output of OR gate 72A and outputs logic value II.

FIG. 21 describes the register settings of the second logic circuit during two-color printing control.

To implement the operation described above, register PC1D, register PC13, register PC11, register PC19, register PC1C, and register PC14 in the second logic circuit 72 are set to "1" and the other registers are set to "0" as shown in FIG. 21.

Figures 22, 23:
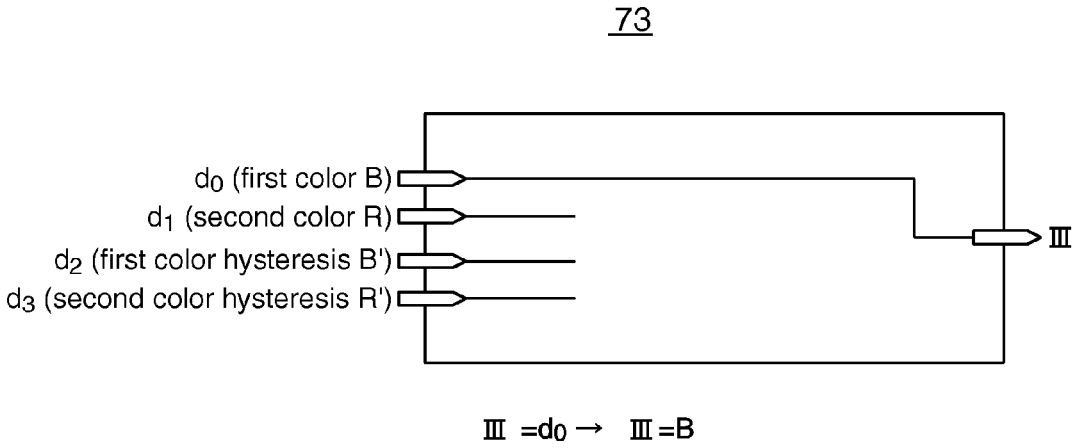
FIG. 22 is an equivalent circuit diagram of the third logic circuit during two-color printing control.
FIG. 23 describes the register settings of the third logic circuit during two-color printing control.

FIG. 22 is an equivalent circuit diagram of the third logic circuit during two-color printing control.

When dot data d0 is input, dot data d0 is output directly as logic value III.

FIG. 23 describes the register settings of the third logic circuit during two-color printing control.

To implement the operation described above, register PC0F, register PC07, register PCO3, register PC0B, register PC0D, register PC05, register PC01, and register PC09 in the third logic circuit 73 are set to "1" and the other registers are set to "0."

(3) Another Method of Two-Color Printing Control

Another method of two-color printing control is described next. This two-color printing control method differs from the above method in that the energize period is divided into four parts, that is, first to fourth drive periods, and the settings are configured to emphasize printing red.

Figure 24:
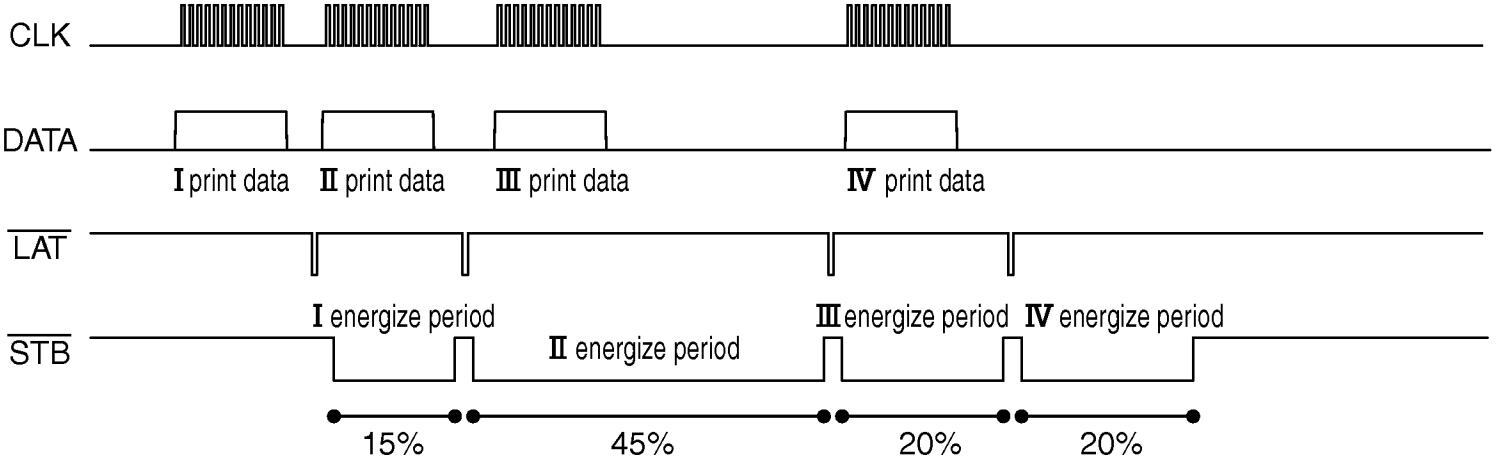
FIG. 24 describes the energizing pattern for another example of two-color printing control.

FIG. 24 describes the energizing pattern in this example of two-color printing control.

The ratio of the lengths of these first to fourth drive periods is 15%, 45%, 20%, and 20%, respectively, in this embodiment of the invention, but the invention is obviously not so limited.

This embodiment of the invention uses the first line buffer B1 (for storing the current black dot data d0), the second line buffer B2 (for storing the previous black dot data d1), the third line buffer B3 (for storing the current red dot data d2), and the fourth line buffer B4 (for storing the previous red dot data d3) of the line buffer unit 31. In addition, dot data d0 is transferred to the first shift register 41, dot data d1 is transferred to the second shift register 42, dot data d2 is transferred to the third shift register 43, and dot data d3 is transferred to the fourth shift register 44.

As shown in FIG. 16, the dot data d0 stored in first shift register 41, the dot data d1 stored in second shift register 42, the dot data d2 stored in third shift register 43, and the dot data d3 stored in fourth shift register 44 is sequentially transferred to first logic circuit 71, second logic circuit 72, and third logic circuit 73, respectively, based on the clock signal CLK output by the sequencer unit 37.

The first logic circuit 71 therefore generates the first drive data I as print data DATA for the first drive period from a logic operation based on the current black dot data d0, the current red dot data d2, and the previous red dot data d3 as the print data DATA, and transfers the first drive data I through the node control circuit unit 35 to the shift register 23 of the print head unit 12.

When the latch signal /LAT then goes LOW, the first drive data I stored in shift register 23 is transferred to latch register 24, and when the inverted strobe signal /STB goes LOW, the drive circuit 22 corresponding to the first drive data I drives the heating element 21 to print.

Parallel to printing the first drive data I, the second logic circuit 72 generates the second drive data II for the second drive period from a logic operation on the current black dot data d0, the previous black dot data d1, and the current red dot data d2, and transfers the second drive data II through the node control circuit unit 35 to the shift register 23 of the print head unit 12.

When the latch signal /LAT then goes LOW, the second drive data II stored in the shift register 23 is transferred to the latch register 24, and when the inverted strobe signal /STB goes LOW, the drive circuit 22 corresponding to the second drive data II drives the heating element 21 to print.

Parallel to printing the second drive data II, the third logic circuit 73 generates the third drive data III for the third drive period from a logic operation based on the current black dot data d0, and transfers the third drive data III through the node control circuit unit 35 to the shift register 23 of the print head unit 12.

When the latch signal /LAT then goes LOW, the third drive data III stored in the shift register 23 is transferred to the latch register 24, and when the strobe signal /STB goes LOW, the drive circuit 22 corresponding to the third drive data III drives the heating element 21 to print.

Parallel to printing the third drive data III, the fourth logic circuit 74 generates fourth drive data IV for the third drive period from a logic operation based on the current black dot data d0, and transfers the fourth drive data IV through the node control circuit unit 35 to the shift register 23 of the print head unit 12.

When the latch signal /LAT then goes LOW, the fourth drive data IV stored in the shift register 23 is transferred to the latch register 24, and when the strobe signal /STB goes LOW, the drive circuit 22 corresponding to the fourth drive data IV drives the heating element 21 to print.

A specific drive pattern is described next.

Figure 25:
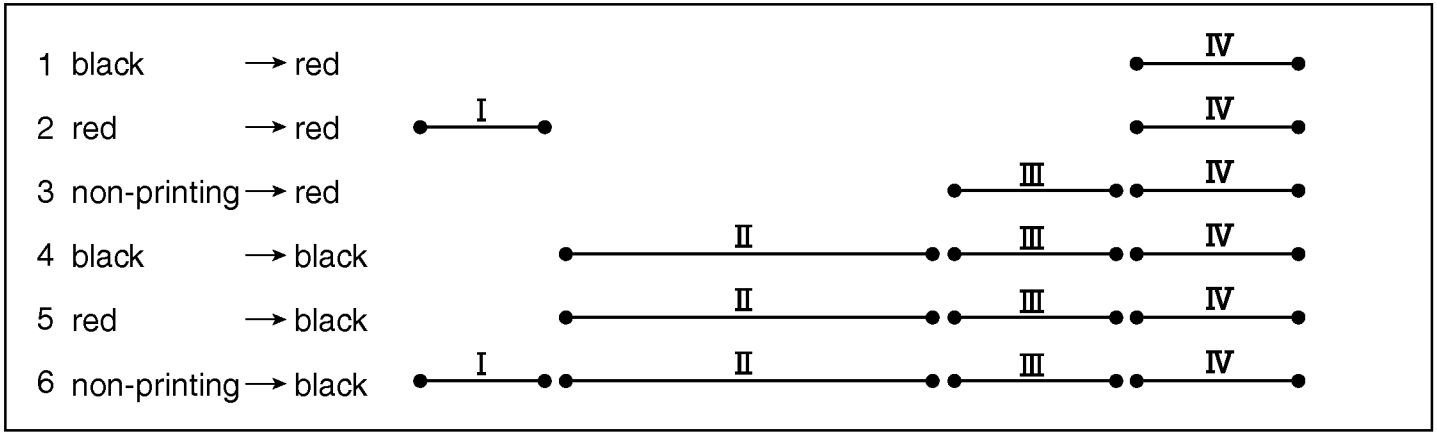
FIG. 25 describes a specific energizing pattern for another example of two-color printing control.

FIG. 25 describes a specific energizing pattern for this example of two-color printing control.

If the previously color printed by a particular dot was black and the current color is red, the heating element is energized only during the fourth drive period. That is, the drive period is the shortest total energizing time.

If the previously color printed was red and the current color is also red, the heating element is energized during the first and fourth drive periods as shown in FIG. 25.

If the previously color printed was blank (nothing printed) and the current color is red, the heating element is energized during the third and fourth drive periods as shown in FIG. 25.

If the previously color printed was black and the current color is black, the heating element is energized during the second drive period, the third drive period, and the fourth drive period as shown in FIG. 25.

If the previously color printed was red and the current color is black, the heating element is energized during the second drive period, the third drive period, and the fourth drive period as shown in FIG. 25.

If the previously color printed was blank (nothing printed) and the current color is black, the heating element is energized during the first drive period, the second drive period, the third drive period, and the fourth drive period as shown in FIG. 25. The total energizing time of the drive period is the longest in this case.

FIG. 26 describes the register settings of the first logic circuit in this example of two-color printing control.

For the operation described in this example, register PC35, register PC31, and register PC3C in the first logic circuit 71 are set to "1" as shown in FIG. 26, and the other registers are set to "0."

FIG. 27 describes the register settings of the second logic circuit in this example of two-color printing control.

As shown in FIG. 27, register PC2F, register PC27, register PC23, register PC21, register PC2D, register PC25, register PC21, and register PC29 of the second logic circuit 72 are set to "1", and the other registers are set to "0."

FIG. 28 describes the register settings of the third logic circuit in this example of two-color printing control.

As shown in FIG. 28, register PC2F, register PC27, register PC23, register PC11, register PC1D, register PC15, register PC11, register PC19, and register PC14 of the third logic circuit 73 are set to "1", and the other registers are set to "0."

FIG. 29 describes the register settings of the fourth logic circuit in this example of two-color printing control.

As shown in FIG. 29, register PC0F, register PC07, register PCO3, register PC01, register PC0D, register PC05, register PC01, register PC09, register PC0C, register PC04, register PC0E, and register PC06 of the fourth logic circuit 74 are set to "1", and the other registers are set to "0."

(4) Single-Stage Hysteresis Control of Gray Scale Printing

Single-stage hysteresis control of gray scale printing is described next.

Figure 30:
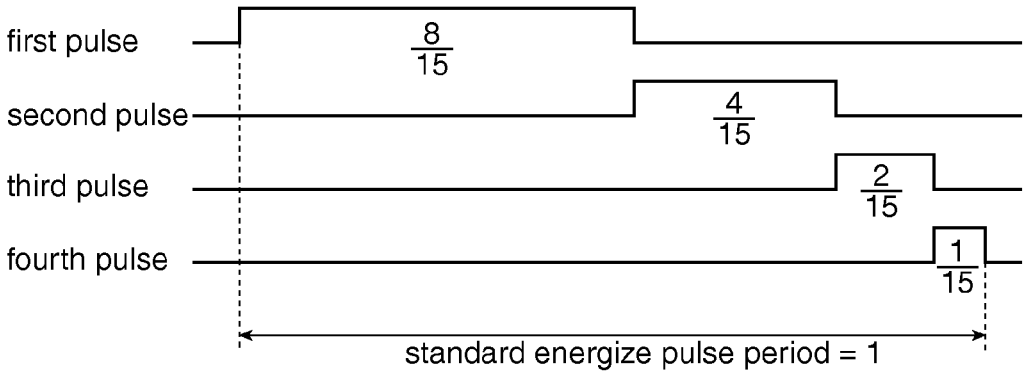
FIG. 30 describes the energizing pulse periods.

FIG. 30 describes the energizing pulse periods.

If the length of a standard energizing pulse period is 1, the length of a first pulse period is 8/15, the length of a second pulse period is 4/15, the length of a third pulse period is 2/15, and the length of a fourth pulse period is 1/15 as shown in FIG. 30.

Figure 31:
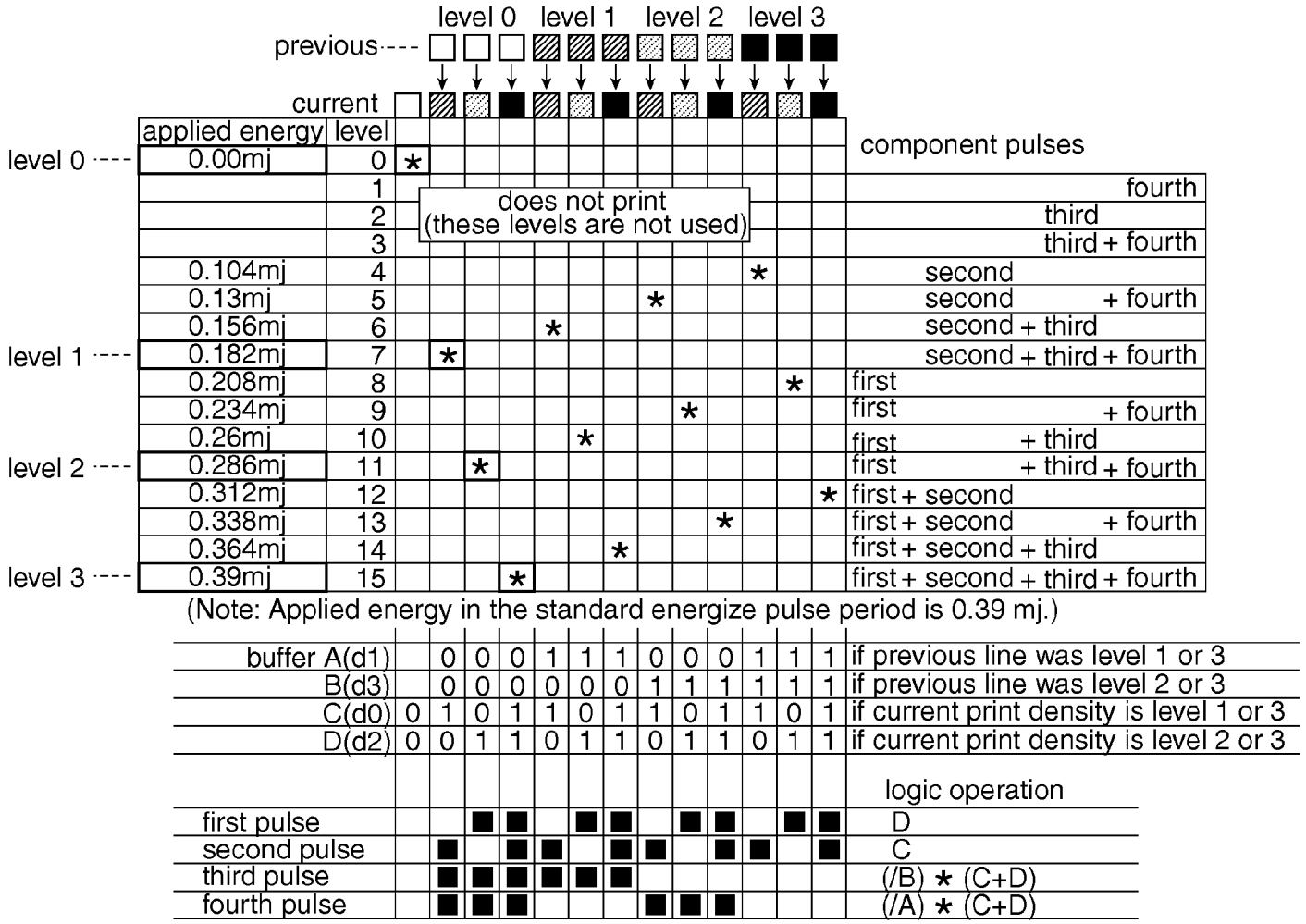
FIG. 31 describes single-stage hysteresis control of gray scale printing.

FIG. 31 describes single-stage hysteresis control of gray scale printing.

This embodiment of the invention prints in four level gray scale ranging from density 0 to density 3 based on the recent dot history.

This embodiment of the invention uses the first line buffer B1 of the line buffer unit 31 (to store dot data d0 when the current print density is level 1 or level 3), the second line buffer B2 (to store dot data d1 when the current print density is level 2 or level 3), the third line buffer B3 (to store dot data d2 when the previous print density was level 1 or level 3), and the fourth line buffer B4 (to store dot data d3 when the previous print density was level 2 or level 3). In addition, dot data d0 is transferred to first shift register 41, dot data d1 is transferred to second shift register 42, dot data d2 is transferred to third shift register 43, and dot data d3 is transferred to fourth shift register 44.

As shown in FIG. 16, the dot data d0 stored in first shift register 41, the dot data d1 stored in second shift register 42, the dot data d2 stored in third shift register 43, and the dot data d3 stored in fourth shift register 44 is sequentially transferred to first logic circuit 71, second logic circuit 72, and third logic circuit 73, respectively, based on the clock signal CLK output by the sequencer unit 37.

The first logic circuit 71 therefore generates the first drive data I as print data DATA for the first drive period from a logic operation based on dot data d2 when the previous print density was level 1 or level 3, and transfers the first drive data I through the node control circuit unit 35 to the shift register 23 of the print head unit 12.

When the latch signal /LAT then goes LOW, the first drive data I stored in shift register 23 is transferred to latch register 24, and when the strobe signal /STB goes LOW, the drive circuit 22 corresponding to the first drive data I drives the heating element 21 to print.

Parallel to printing the first drive data I, the second logic circuit 72 generates the second drive data II for the second drive period from a logic operation based on the dot data d0 when the current print density is level 1 or level 3, and transfers the second drive data II through the node control circuit unit 35 to the shift register 23 of the print head unit 12.

When the latch signal /LAT then goes LOW, the second drive data II stored in the shift register 23 is transferred to the latch register 24, and when the strobe signal /STB goes LOW, the drive circuit 22 corresponding to the second drive data II drives the heating element 21 to print.

Parallel to printing the second drive data II, the third logic circuit 73 generates the third drive data III for the third drive period from a logic operation based on dot data d0 when the current print density is level 1 or 3, dot data d2 when the previous print density was level 1 or level 3, and dot data d3 when the previous print density was level 2 or level 3, and transfers the third drive data III through the node control circuit unit 35 to the shift register 23 of the print head unit 12.

When the latch signal /LAT then goes LOW, the third drive data III stored in the shift register 23 is transferred to the latch register 24, and when the strobe signal /STB goes LOW, the drive circuit 22 corresponding to the third drive data III drives the heating element 21 to print.

Parallel to printing the third drive data III, the fourth logic circuit 74 generates fourth drive data IV for the third drive period from a logic operation based on dot data d0 when the current print density is level 1 or 3, dot data d1 when the current print density is level 2 or level 3, and dot data d2 when the previous print density was level 1 or level 3, and transfers the fourth drive data IV through the node control circuit unit 35 to the shift register 23 of the print head unit 12.

When the latch signal /LAT then goes LOW, the fourth drive data IV stored in the shift register 23 is transferred to the latch register 24, and when the strobe signal /STB goes LOW, the drive circuit 22 corresponding to the fourth drive data IV drives the heating element 21 to print.

FIG. 32 describes the register settings of the first logic circuit during single-stage hysteresis control of gray scale printing.

As shown in FIG. 32, during single-stage hysteresis control of gray scale printing, register PC3E, register PC3C, register PC3B, register PC3D, register PC37, register PC35, register PC34, and register PC36 in the first logic circuit 71 are set to "1", and the other registers are set to "0."

FIG. 33 describes the register settings of the second logic circuit during single-stage hysteresis control of gray scale printing.

As shown in FIG. 33, register PC2F, register PC27, register PC23, register PC2B, register PC2D, register PC25, register PC21, and register PC29 in the second logic circuit 72 are set to "1", and the other registers are set to "0."

FIG. 34 describes the register settings of the third logic circuit during single-stage hysteresis control of gray scale printing.

As shown in FIG. 34, register PC13, register PC1B, register PC11, register PC19, register PC10, register PC18, register PC12, and register PC1A in the third logic circuit 73 are set to "1", and the other registers are set to "0."

FIG. 35 describes the register settings of the fourth logic circuit during single-stage hysteresis control of gray scale printing.

As shown in FIG. 35, register PC05, register PC01, register PC09, register PC0C, register PC00, and register PC08 in the fourth logic circuit 74 are set to "1", and the other registers are set to "0."

As described above, this embodiment of the invention uses a logic circuit to provide single-stage hysteresis control of gray scale printing.

(5) Thirteen-Level Gray Scale Control of Gray Scale Printing

Thirteen-level gray scale control of gray scale printing is described next.

As described in FIG. 30, if the length of a standard energizing pulse period is 1, the length of a first pulse period is 8/15, the length of a second pulse period is 4/15, the length of a third pulse period is 2/15, and the length of a fourth pulse period is 1/15.

This embodiment of the invention prints in thirteen level gray scale ranging from density 0 to density 12.

FIG. 36 describes thirteen-level gray scale control of gray scale printing.

This embodiment of the invention uses the first line buffer B1 of the line buffer unit 31 (to store dot data d0 for print density level 5 and higher), the second line buffer B2 (to store dot data d1 for print density levels 1 to 4 and density levels 9 to 12), the third line buffer B3 (to store dot data d2 for print density levels 3, 4, 7, 8, 11, 12), and the fourth line buffer B4 (to store dot data d3 for print density levels 2, 4, 6, 8, 10, 12). In addition, dot data d0 is transferred to first shift register 41, dot data d1 is transferred to second shift register 42, dot data d2 is transferred to third shift register 43, and dot data d3 is transferred to fourth shift register 44.

As shown in FIG. 16, the dot data d0 stored in first shift register 41, the dot data d1 stored in second shift register 42, the dot data d2 stored in third shift register 43, and the dot data d3 stored in fourth shift register 44 is sequentially transferred to first logic circuit 71, second logic circuit 72, and third logic circuit 73, respectively, based on the clock signal CLK output by the sequencer unit 37.

The first logic circuit 71 therefore generates the first drive data I as print data DATA for the first drive period from a logic operation based on dot data d0 when the print density level is 5 or higher, and transfers the first drive data I through the node control circuit unit 35 to the shift register 23 of the print head unit 12.

When the latch signal /LAT then goes LOW, the first drive data I stored in shift register 23 is transferred to latch register 24, and when the strobe signal /STB goes LOW, the drive circuit 22 corresponding to the first drive data I drives the heating element 21 to print.

Parallel to printing the first drive data I, the second logic circuit 72 generates the second drive data II for the second drive period from a logic operation based on the dot data d1 for print density levels 1 to 4, and transfers the second drive data II through the node control circuit unit 35 to the shift register 23 of the print head unit 12.

When the latch signal /LAT then goes LOW, the second drive data II stored in the shift register 23 is transferred to the latch register 24, and when the strobe signal /STB goes LOW, the drive circuit 22 corresponding to the second drive data II drives the heating element 21 to print.

Parallel to printing the second drive data II, the third logic circuit 73 generates the third drive data III for the third drive period from a logic operation based on dot data d2 for print density levels 3, 4, 7, 8, 11, 12, and transfers the third drive data III through the node control circuit unit 35 to the shift register 23 of the print head unit 12.

When the latch signal /LAT then goes LOW, the third drive data III stored in the shift register 23 is transferred to the latch register 24, and when the strobe signal /STB goes LOW, the drive circuit 22 corresponding to the third drive data III drives the heating element 21 to print.

Parallel to printing the third drive data III, the fourth logic circuit 74 generates fourth drive data IV for the third drive period from a logic operation based on dot data d3 when the print density level is 2, 4, 6, 8, 10, or 12, and transfers the fourth drive data IV through the node control circuit unit 35 to the shift register 23 of the print head unit 12.

When the latch signal /LAT then goes LOW, the fourth drive data IV stored in the shift register 23 is transferred to the latch register 24, and when the strobe signal /STB goes LOW, the drive circuit 22 corresponding to the fourth drive data IV drives the heating element 21 to print.

FIG. 37 describes the register settings of the first logic circuit during thirteen-level gray scale control of gray scale printing.

To implement this operation, register PC3F, register PC37, register PC33, register PC3B, register PC3D, register PC35, register PC31, and register PC39 in the first logic circuit 71 are set to "1", and the other registers store 0 as shown in FIG. 37.

FIG. 38 describes the register settings of the second logic circuit during thirteen-level gray scale control of gray scale printing.

As shown in FIG. 38, register PC2F, register PC27, register PC23, register PC2B, register PC2E, register PC26, register PC22, and register PC2A of the second logic circuit 72 are set to "1", and the other registers are set to "0."

FIG. 39 describes the register settings of the third logic circuit during thirteen-level gray scale control of gray scale printing.

As shown in FIG. 39, register PC1F, register PC17, register PC1C, register PC15, register PC1C, register PC14, register PC1E, and register PC16 of the third logic circuit 73 are set to "1", and the other registers are set to "0."

FIG. 40 describes the register settings of the fourth logic circuit during thirteen-level gray scale control of gray scale printing.

As shown in FIG. 40, register PC0F, register PC0B, register PC0D, register PC09, register PC0C, register PC08, register PC0E, and register PC0A of the fourth logic circuit 74 are set to "1", and the other registers are set to "0."

As described above, this embodiment of the invention uses a logic circuit to provide gray scale printing control in thirteen levels.

It will thus be obvious that the present invention enables using a single logic circuit arrangement to control plural print modes, and the control logic can be easily dynamically changed to afford high quality printing in each print mode.

The logic can also be easily changed while printing is in progress, thus affording compatibility with a wide range of printing needs.

Although the present invention has been described in connection with the preferred embodiments thereof with reference to the accompanying drawings, it is to be noted that various changes and modifications will be apparent to those skilled in the art. For example, four logical buffers B1 to B4 are used in this embodiment of the invention, but as few as two logical buffers can be used depending on the print modes. Such changes and modifications are to be understood as included within the scope of the present invention as defined by the appended claims, unless they depart therefrom.

What is claimed is:

1. A printing control unit for supplying drive signals to a print head unit based on pixel printing data from a host, the printing control unit comprising:

a configuration registration unit for storing configuration data for setting data logic of a logic circuit unit according to supply patterns of the drive signals;

the logic circuit unit comprising a logic circuit for outputting output data according to the configuration data and the pixel printing data, and an output circuit for outputting the drive signals based on the output data;

a line buffer unit for accumulating current dot printing data supplied from the host;

a shift register unit for getting and passing the current dot printing data and previous dot history data from the line buffer unit to the logic circuit unit;

a node control circuit unit for switching the logic circuit unit to output the output data to the print head unit: and a sequencer unit for controlling the sequence of the shift register unit, the logic circuit unit, and the node control circuit unit;

wherein the logic circuit unit updates logic operations applied to the pixel printing data according to the configuration data and changes the drive signals to track the supply patterns.

2. The printing control unit described in claim 1, wherein:

the printing control unit corrects the current dot printing data based on the previous dot history data and supplies the corrected current dot printing data to the print head unit.

* * * * *